US011648577B1

(12) United States Patent
Byeon

(10) Patent No.: US 11,648,577 B1
(45) Date of Patent: May 16, 2023

(54) COSMETIC CONTAINER AND PUMPING MEMBER FOR COSMETIC CONTAINER

(71) Applicant: Sung Jin Cosmetics Co., Ltd., Seoul (KR)

(72) Inventor: Young-Kwang Byeon, Seoul (KR)

(73) Assignee: SUNG JIN COSMETICS CO., LTD., Seoul (KR)

( * ) Notice: Subject to any disclaimer, the term of this patent is extended or adjusted under 35 U.S.C. 154(b) by 0 days.

(21) Appl. No.: 17/725,681

(22) Filed: Apr. 21, 2022

(30) Foreign Application Priority Data

Dec. 31, 2021 (KR) ..... 10-2021-0194275

(51) Int. Cl.
*B05B 11/00* (2023.01)
*B05B 11/10* (2023.01)

(52) U.S. Cl.
CPC ..... *B05B 11/1033* (2023.01); *B05B 11/1069* (2023.01)

(58) Field of Classification Search
CPC ..... B05B 11/3033; B05B 11/3069
See application file for complete search history.

(56) References Cited

U.S. PATENT DOCUMENTS 10,493,475 B1 * 12/2019 Yang ..... B05B 11/007
10,898,916 B1 * 1/2021 Rossignol ..... B05B 11/3033
2014/0103071 A1 * 4/2014 Park ..... B05B 11/00416 222/207
2019/0366376 A1 * 12/2019 Rossignol ..... B05B 15/30
2020/0130002 A1 * 4/2020 Baumann ..... B05B 11/3035
2020/0197967 A1 * 6/2020 Rossignol ..... B05B 11/3069

FOREIGN PATENT DOCUMENTS

KR 10-1805595 12/2017
KR 10-1966742 4/2019
KR 10-2110708 5/2020

* cited by examiner

*Primary Examiner* — Frederick C Nicolas
(74) *Attorney, Agent, or Firm* — Lex IP Meister, PLLC

(57) ABSTRACT

The cosmetic container includes: a housing provided to be brought into close contact with an opened upper end of a container body and having a hole formed in a central portion thereof to communicate with an interior of the container body; a pumping member provided inside the housing to be connected to the hole, having a content accommodation space defined therein, and configured to be elastically compressed or expanded along an axial direction to transfer the contents in one direction along an axial direction; and a nozzle member coupled to the pumping member and having an internal conduit to allow the contents to move, and configured to connect the pumping member and the outlet, compress the pumping member with an operation of the discharge head, and selectively open or close between the inner conduit and an internal space of the pumping member.

13 Claims, 13 Drawing Sheets

COSMETIC CONTAINER AND PUMPING MEMBER FOR COSMETIC CONTAINER

CROSS-REFERENCE TO RELATED APPLICATION

This application claims priority to and the benefit of Korean Patent Application No. 10-2021-0194275 filed in the Korean Intellectual Property Office on Dec. 31, 2021, the entire contents of which are incorporated herein by reference.

BACKGROUND OF THE INVENTION

(a) Field of the Invention

The present disclosure relates to a cosmetic container and a pumping member provided in a cosmetic container to discharge contents.

(b) Description of the Related Art

For example, liquid cosmetics are accommodated in a cosmetic container and are discharged from the container at the time of need. The interior of the cosmetic container in which the liquid cosmetics as contents are accommodated is provided with a pumping device for pumping the contents to discharge the same to the outside. The pumping device is pressed by an external force applied by a user so that the contents are pumped to be discharged through an outlet of the container.

The pumping device of the cosmetic container has a complicated structure and a large number of constituent elements. This complicates an assembling process and increases the manufacturing costs of the cosmetic container.

In this regard, the present inventors have developed a cosmetic container having a reduced number of constituent elements and a simplified configuration and configured to be able to smoothly discharge a certain amount of contents, which is improved in configuration as compared with a cosmetic container in the related art. Korean Registration Patent Nos. 10-1805595, 10-1966742, and 10-2110708 as patent registration documents disclose a cosmetic container and a pumping device, which have been developed by the present inventors.

If the structure and shape of a pumping member are complex, it is difficult to injection-mold a cosmetic container with an eco-friendly material used for a typical cosmetic container. In addition, the pumping member may be injection-molded with a material that is not 100% eco-friendly material. However, such a material is not recyclable and may be deformed by the accommodated cosmetics. In addition, this may cause inconvenience of having to separate and collect the cosmetic container at the time of disposing.

In recent years, as the usage of the cosmetics gradually increases, there is an increasing requirement for a cosmetic container capable of sufficiently performing a pumping operation at a low manufacturing cost. Therefore, a demand has existed for the development of a pumping member capable of being easily manufactured with a simplified configuration and discharging liquid contents in an efficient manner, and a cosmetic container to which the pumping member is applied.

SUMMARY OF THE INVENTION

The present disclosure is for the purpose of providing a cosmetic container which is easy to manufacture with a relatively simplified configuration, and a pumping member for the cosmetic container.

The present disclosure is also for the purpose of providing a cosmetic container and a pumping member for the cosmetic container, which are capable of being manufactured by performing an injection-molding with a material used for a general cosmetic container.

The present disclosure is also for the purpose of providing a cosmetic container and a pumping member for the cosmetic container, which are capable of being easily separated and collected for recycling after use.

The present disclosure is also for the purpose of providing a cosmetic container and a pumping member for the cosmetic container, which are capable of being deformed in various sizes according to an amount of discharged cosmetics.

A pumping member of an example embodiment may be made of a non-metallic elastic material, and may be provided between a container body configured to store contents of a cosmetic container and a discharge head configured to discharge the contents so as to transfer the contents, which is accommodated in an internal space of the pumping member, to the discharge head by a pumping operation implemented by being elastically compressed or expanded along an axial direction.

The pumping member may include a lower part coupled to the container body and in communication with the container body, and an upper part in communication with the discharge head, wherein the upper part and the lower part may be separated from each other and detachably coupled to each other.

A cosmetic container of another example embodiment may include: a container body in which contents are accommodated; a pumping device coupled to an opened upper end of the container body and configured to discharge the contents accommodated in the container body by a pumping operation based on an elasticity of the pumping device; a discharge head connected to the pumping device to apply a discharge pressure to the pumping device and having an outlet formed in one side to communicate with the pumping device and through which the contents are discharged.

The pumping device may include: a housing which is brought into close contact with the opened upper end of the container body and has a hole formed in a central portion of the housing to communicate with an interior of the container body; a pumping member provided inside the housing to be connected to the hole of the housing and having a content accommodation space defined therein, wherein the pumping member is elastically compressed or expanded along an axial direction to transfer the contents in one direction along the axial direction; and a nozzle member coupled to the pumping member and having an internal conduit formed therein to allow the contents to move, and configured to connect the pumping member and the outlet, compress the pumping member with an operation of the discharge head, and selectively open or close between the inner conduit and an internal space of the pumping member.

The pumping member may include a lower part connected to the hole of the housing, and an upper part coupled to the nozzle member, and the upper part and the lower part may be configured to be separated from each other and be detachably coupled to each other.

The lower part may include: a pressure portion having an internal space defined therein and configured to be compressed and elastically restored by an external force to vary a pressure of the internal space; a flange formed to protrude outward from a lower outer circumferential surface of the pressure portion so as to be brought into close contact with a stepped portion of the housing; a check valve formed integrally with a lower portion of the pressure portion and configured to selectively open or close the hole of the housing so as to allow the contents to flow from the container body into the pressure portion in the one direction; and a groove portion formed to extend upward from an upper end of the pressure portion so as to be coupled to the upper part.

The upper part may include: an insertion portion coupled to the nozzle member and in selective communication with an inner conduit of the nozzle member; a blocking member whose inner diameter is increased inside the insertion portion in an elastic manner to form a passage through which the contents are discharged, and configured to be brought into close contact with the nozzle member to block between the pressure portion and the inner conduit of the nozzle member; an extension/contraction portion formed in the insertion portion and configured to open or close between the blocking member and the nozzle member by extending or contracting the insertion portion in the elastic manner with a driving of the discharge head; and a ring portion formed at a lower end of the extension/contraction portion to be fitted into and coupled to the groove portion of the lower portion.

The pumping member may further include at least one intermediate part stacked between the upper part and the lower part.

The at least one intermediate part may have opened upper and lower ends and an internal space formed therein, and may be configured to connect the upper part and the lower part, wherein the ring portion, which is fitted into and coupled to the groove portion of the lower part, may be formed on the lower end of the intermediate part, the groove portion into and to which the ring portion is fitted and coupled may be formed in the upper end of the intermediate part, and a deformable portion, which is compressed and elastically restored by the external force to vary a pressure of the internal space, may be formed between the ring portion and the groove portion.

The pumping member may be formed of a material such as silicon, rubber or a synthetic resin.

The extension/contraction portion may have an elastic modulus relatively larger than that of the pressure portion, and may be configured to be deformed earlier than the pressure portion by an external force applied thereto.

The nozzle member may include: a nozzle body in which an inner conduit through which the contents are transferred is formed and which is fitted into and brought into close contact with an upper portion of the insertion portion of the pumping member; a connection pipe extending in the axial direction on an upper end of the nozzle body, in which the inner conduit is formed and to which the discharge head is coupled; a fitting portion formed on a lower end of the nozzle body to be inserted into the blocking member of the insertion portion; an inflow hole formed in a lateral surface of the fitting portion to communicate interiors of the inner conduit and the insertion portion with each other; and an extended portion formed to protrude outward from an outer circumferential surface of the lower end of the fitting portion to be brought into close contact with an inner surface of the blocking member so as to block between the insertion portion and the extension/contraction portion.

The cosmetic container may further include a piston member provided to be brought into close contact with the interior of the container body in a sliding manner, and configured to move as the contents are discharged and push the contents toward the opened upper end.

The nozzle member may be formed integrally with the discharge head.

The cosmetic container may further include an inflow tube connected to the pumping device and extending to the inner bottom of the container body, and into which the contents flow.

The cosmetic container may further include a skirt portion formed integrally with the lower outer circumferential surface of the pressure portion and having an outer diameter that becomes larger downward so that the skirt portion is brought into close contact with the inner surface of the cylinder chamber of the housing in an elastic manner.

At least one trench may be formed at an interval in the stepped portion of the housing to form a gap between the stepped portion and the flange at a portion in contact with the flange of the pumping member so that air allows to flow into the at least one trench through the gap.

The cosmetic container may further include an auxiliary check valve provided on the inner conduit to selectively block the inner conduit and configured to discharge the contents toward the discharge head in the one direction.

The cosmetic container may further include: a mounting groove formed to be depressed in a groove shape to receive the auxiliary check valve in the concave portion of the discharge head; and a cover detachably provided in the mounting groove and having a hole formed in a surface of the cover to discharge the contents therethrough, and configured to cover and protect the auxiliary check valve.

According to this example embodiment, by separating a pumping member, which is hard to injection-mold due to a complicated shape in the related art, into a plurality of parts and injection-molding for each of the plurality of parts, it is possible to more easily manufacture the pumping member and reduce a cost required to manufacture the pumping member, thus improving price competitiveness of the product.

Further, it is possible to variously change the size of a pumping member by stacking a plurality of parts to meet various types of cosmetic containers. This makes it possible to manufacture the pumping member of a desired size by assembling respective parts without additionally manufacturing pumping members adapted for the type or size of the cosmetic container, and an amount of discharged cosmetics. This eliminates a need to design and manufacture a pumping member adapted for each cosmetic container, which makes it possible to reduce a cost required for manufacturing the pumping member.

It is possible to manufacture a pumping member having a complicated structure with a general-purpose material used fora general cosmetic container. This makes it possible to prevent deformation of cosmetics. Furthermore, the pumping member may be collected and recycled together with the cosmetic container without separating the pumping member after use. This makes it possible to reduce the time and cost required for recycling treatment.

DETAILED DESCRIPTION OF EXEMPLARY EMBODIMENTS

Figure 1:
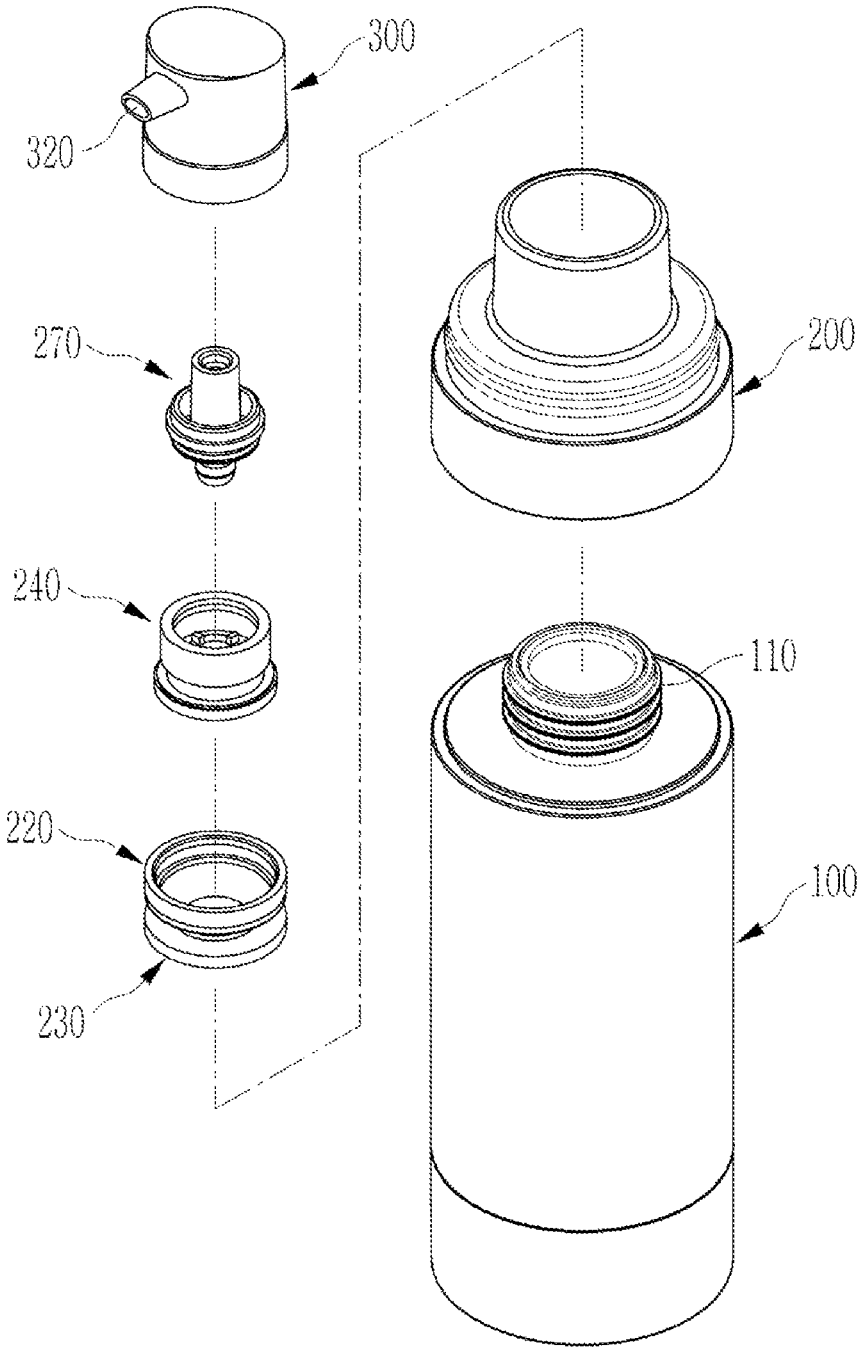
FIG. 1 is a schematic exploded perspective view of a cosmetic container according to an example embodiment of the present disclosure.

Hereinafter, example embodiments of the present disclosure will be described in detail. However, the example embodiments are exemplary in all respects and are not restrictive. The present disclosure is merely defined by the scope of the appended claims. The example embodiments described below may be modified in various forms without departing from the spirit and scope of the appended claims. In all the accompanying drawings, the same or similar components will be denoted by the same reference numerals.

The technical terms used herein are merely referred to specific example embodiments and are not intended to limit the present disclosure. The singular terms used herein also include the plural terms unless the terms clearly represent the opposite meanings. The meaning of "includes" used herein refers to include certain characteristics, regions, integers, steps, operations, elements, and/or components and does not mean that the presence or addition of other certain characteristics, regions, integers, steps, operations, elements, components, and/or groups is excluded.

Hereinafter, preferred example embodiments of the present disclosure will be described with reference to the drawings. However, example embodiments described later are merely preferred example embodiments of the present disclosure and the present disclosure is not limited to the example embodiments described later.

Figure 2:
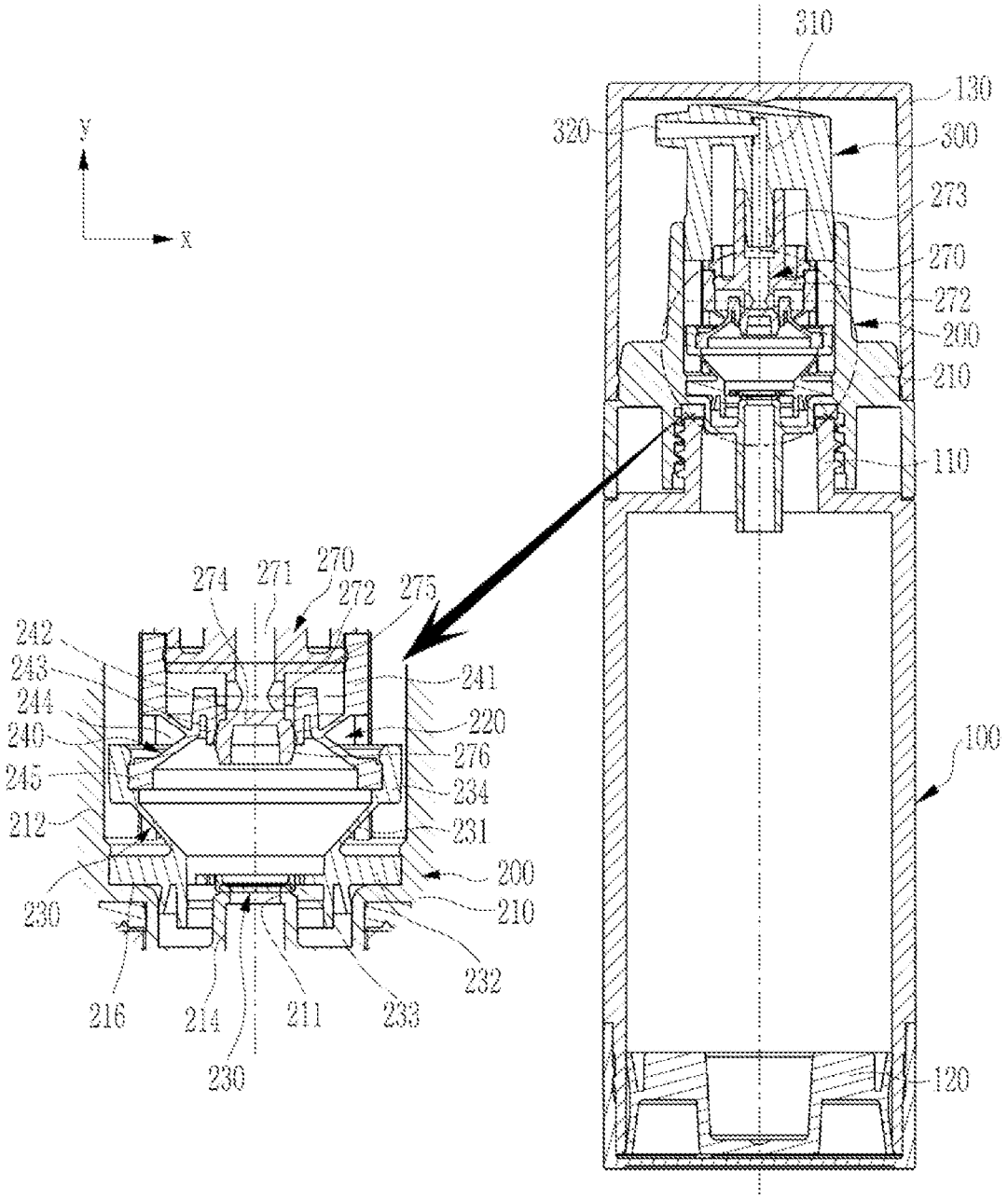
FIG. 2 is a cross-sectional view of the cosmetic container according to the example embodiment.
Figure 3:
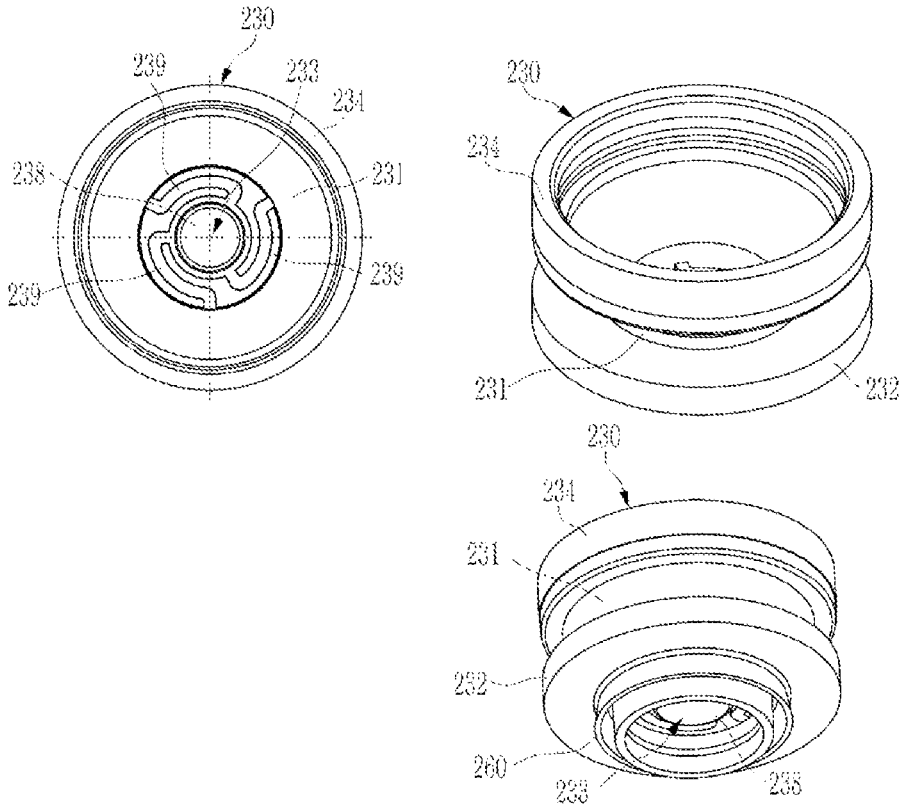
FIGS. 3 to 6 illustrate constituent elements of a pumping member according to an example embodiment of the present disclosure, respectively.

FIG. 1 illustrates a cosmetic container according to an example embodiment of the present disclosure, and FIG. 2 illustrates a cross-sectional structure of the cosmetic container.

In the following description, an axial direction refers to a direction in which the central axis line passes, and is defined as a Y-axis direction in FIG. 2. Above, an upper portion or an upward direction used herein refers to a direction oriented upward in the Y-axis direction when the cosmetic container is oriented upward as in FIG. 2, and below, a lower portion or a downward direction refers to a direction opposite the upward direction.

As illustrated in the figures, the cosmetic container according to the example embodiment may include a container body 100 in which contents are accommodated, a pumping device 200 coupled to an upper opening 110 of the container body 100 and configured to discharge the contents accommodated in the container body 100 by a pumping operation based on its own resilience, and a discharge head 300 connected to the pumping device 200 and configured to apply a discharge pressure to the pumping device 200. The discharge head 300 includes an outlet 320 in communication with the pumping device 200 to discharge the contents therethrough.

The container body 100 may have a barrel structure with an internal space for accommodating contents therein. The internal space of the container body 100 may be filled with various kinds of cosmetics (hereinafter referred to as "contents"). The contents may be quasi-drugs such as disinfectant, or household items such as detergent, in addition to the cosmetics. The shape of the container body 100 may be variously modified.

The container body 100 has the upper opening 110 formed at the upper portion thereof. The upper opening 110 of the container body 100 is connected to the pumping device 200. Thus, the contents accommodated in the container body 100 are discharged from the upper opening 110 by the pumping device 200 and discharged to the outside through the discharge head 300.

Reference numeral 130 is an upper cap for covering and protecting the discharge head 300.

The cosmetic container of the example embodiment may further include a piston member 120 provided inside the container body 100. The piston member 120 is brought into close contact with an inner surface of the container body 100 and is provided to be slidable along the inner surface. As the contents in the container body 100 are discharged by the pumping device 200, the piston member 120 is raised toward the upper opening 110. At this time, since external air enters the container body 100 through a hole formed in the bottom of the container body 100, the piston member 120 may be smoothly raised and the outer shape of the container body 100 may be maintained without any deformation. The piston member 120 is raised toward the upper opening 110 of the container body 100 by an amount of the contents discharged from the container body 100 so that an internal pressure of the container body 100 are kept constant. Further, the contents in the container body 100 is be biased toward the upper opening 110 by the piston member 120 and subsequently, is smoothly discharged through the upper opening 110.

The pumping device 200 may be detachably coupled to the upper opening 110 of the container body 100. For example, a male screw may be formed on an outer circumferential surface of the upper opening 110 of the container body 100 and a female screw may be formed on an inner circumferential surface of the pumping device 200 so that they are threadedly coupled to each other. The pumping device 200 may be coupled to the upper opening 110 of the container body 100 in various manners other than the threadedly-coupling manner, but is not particularly limited thereto.

The discharge head 300 is coupled to the pumping device 200 to drive the pumping device 200 by applying pressure to the pumping device 200. In the example embodiment, the discharge head 300 may have a structure that is pressed upward and downward to drive the pumping device 200. The discharge head 300 includes an inner conduit 310 formed to be connected to the pumping device 200. A tip end of the discharge head 300 forms an outlet 320 through which the contents transferred through the conduit 310 is discharged.

With this configuration, when a user presses the discharge head 300, the discharge head 300 applies the pressure to the pumping device 200 to drive the pumping device 200. Thus, the contents discharged by the pumping device 200 are moved along the conduit 310 of the discharge head 300, and are discharged through the outlet 320 of the tip end. The shape of the discharge head 300 may be variously modified.

The pumping device 200 is coupled to the upper opening 110 of the container body 100 to transfer the contents accommodated in the container body 100 to the discharge head 300 with the operation of the discharge head 300.

The pumping device 200 itself has elasticity. Thus, the pumping device 200 may vary the internal pressure thereof due to its own elastic pumping operation, thereby discharging the contents in the container body 100.

Each constituent element of the pumping device 200 will be described with reference to FIGS. 2 to 6.

The pumping device 200 may be brought into close contact with the upper opening 110 of the container body 100. The pumping device 200 may be provided with: a housing 210 having a hole 211 formed at the central portion thereof to communicate with the interior of the container body 100; a pumping member 220 provided inside the housing 210 to be connected to the hole 211 of the housing 210 and having an internal space for accommodating the contents, wherein the pumping member 220 is elastically compressed or expanded along an axial direction of the housing 210 to transfer the contents in one direction along the axial direction; and a nozzle member 270 coupled to the pumping member 220 and including an inner conduit 271 formed to move the contents through, wherein the nozzle member 270 connects the pumping member 220 and the discharge head 300 to compress the pumping member 220 with the operation of the discharge head 300, and selectively opens and closes an internal space between the inner conduit 271 and the pumping member 220.

The housing 210 is coupled to the container body 100 to operably support each constituent element of the pumping device 200 inside the housing 210.

The housing 210 may have a circular cylindrical structure with open upper and lower ends. The housing 210 is tightly mounted to the upper opening 110 of the container body 100. For example, a female screw may be formed on an inner circumferential surface of the lower end of the housing 210 to be coupled to the upper opening 110 of the container body 100 in a threadedly-coupling manner. The hole 211 is formed in the central portion of the lower end of the housing 210 to be in communication with the container body 100.

In the example embodiment, the housing 210 may have a structure having different inner diameters along the axial direction. Hereinafter, portions having the different inner diameters will be referred to as an operation chamber 212 and a cylinder chamber 214, respectively. The operation chamber 212 is a chamber in which the pumping operation by the nozzle member 270 and the pumping member 220 is performed. The cylinder chamber 214, which is defined below the operation chamber 212, is a chamber with which a skirt portion of the pumping member 220 in a cosmetic container (to be described later) including an inflow tube 122 is brought into close contact. Details thereof will be described later.

Between the operation chamber 212 having a relatively large diameter and the cylinder chamber 214 below the operation chamber 212, a horizontal stepped portion 216 is formed depending on such a difference in diameter. A flange 232 formed at the lower portion of the pumping member 220 may be fixed to the stepped portion 216 in a contact manner.

The pumping member 220 is provided inside the housing 210.

The upper end of the pumping member 220 is provided with a nozzle member 270, and the lower end thereof is connected to the hole 211 of the housing 210. The pumping member 220 selectively connects the interior of the container body 100 and the inner conduit 271 of the nozzle member 270 to transfer the contents to the nozzle member 270.

The pumping member 220 of the example embodiment may have a structure in which a plurality of individual parts is coupled to each other to make up a single body.

Specifically, the pumping member 220 of the example embodiment may include a lower part 230 connected to the hole 211 of the housing 210, and an upper part 240 which is separately provided from the lower part 230 and coupled to the nozzle member 270. The upper part 240 and the lower part 230 may be configured to be detachably coupled to each other. Hereinafter, the pumping member 220 may refer to the entire integrated constituent element obtained by coupling the lower part 230 and the upper part 240.

With this configuration, by designing a pumping member in the related art, which has a complicated shape and is hard to mold, into a large number of separable parts, and molding the pumping member on the basis of each part, it is possible to more easily manufacture the pumping member.

The lower part 230 may include: a pressure portion 231 which defines an internal space therein and is compressed and elastically restored by an external force to vary a pressure of the internal space; the flange 232 which is formed to be protruded outward from a lower outer circumferential surface of the pressure portion 231 and is brought into close contact with the stepped portion 216 of the housing 210; a check valve 233 which is formed integrally with the lower portion of the pressure portion 231 to selectively open and close the holes 211 of the housing 210 and to cause the contents to flow from the container body 100 into the pressure portion 231 in one direction; and a groove portion 234 which is formed to extend upward from the upper end of the pressure portion 231 to be coupled to the upper part 240.

The upper part 240 may include: an insertion portion 241 which is coupled to the nozzle member 270 and selectively communicates with the inner conduit 310 of the nozzle member 270; a blocking member 243 whose inner diameter is increased inside the insertion portion 241 in an elastic manner to form a passage 242 through which the contents are discharged, wherein the blocking member 243 is brought into close contact with the nozzle member 270 to block between the pressure portion 231 and the inner conduit 310 of the nozzle member 270; an extension/contraction portion 244 which is formed in the insertion portion 241 to extend or contract the insertion portion 241 in an elastic manner with the driving of the discharge head 300, and open and close between the blocking member 243 and the nozzle member 270; and a ring portion 245 which is formed at a lower end of the extension/contraction portion 244 to be fitted into and coupled to the groove portion 234 of the lower portion 230.

With this configuration, by fitting the ring portion 245 formed at the lower end of the upper part 240 into the groove portion 234 formed at the upper end of the lower part 230, a single pumping member 220 may be formed.

The groove portion 234 of the lower part 230 may be brought into close contact with the ring portion 245 of the upper part 240 so that they are coupled to each other while being kept airtight. A lower stepped portion 235 is formed at an inner lower portion of the groove portion 234 to lock a lower end of the ring portion 245. An upper stepped portion 236 is formed at an upper portion of the groove portion 234 to protrude inward of the groove portion 234 and be locked to an upper end of the ring portion 245. The ring portion 245 may be provided to be fitted between the lower stepped portion 235 and the upper stepped portion 236. Further, a protrusion 237 is formed on the inner circumferential surface of the groove portion 234 to protrude along the inner circumferential surface between the lower stepped portion 235 and the upper stepped portion 236 so that the protrusion 237 may be brought into close contact with the tip end of the ring portion 245 in a pressing manner. Further, the ring portion 245 may include a groove 246 formed along the periphery of the upper end of the ring portion 245 to be fitted into the upper stepped portion 236.

In this configuration, by coupling the lower part 230 and the upper part 240, the ring portion 245 is fitted between the upper stepped portion 236 and the lower stepped portion 235 of the groove portion 234, and the groove 246 in the upper end of the groove portion 234 is tightly coupled to the upper stepped portion 236 while being engaged with the upper stepped portion 236. The protrusion 237 formed on the inner circumferential surface of the groove portion 234 is brought into close contact with the outer circumferential surface of the ring portion 245 in a pressing manner so that a space between the groove portion 234 and the ring portion 245 are perfectly sealed.

Thus, the pumping member 220 of the example embodiment may prevent the contents from flowing out through the coupling portion between the upper part 240 and the lower part 230 even when they are coupled to each other.

The pumping member 220 itself is compressed or elastically returned to vary the pressure of the internal space, thereby transferring the contents in one direction.

The term "compression" means that the volume is reduced by being pressed by an external force from its original state. The term "expansion" means that the volume is increased in the compressed state and returns to its original state. As described above, the pressure portion 231 of the lower part 230 and the extension/contraction portion 244 of the upper part 240 have an elastically-deformable shape. In a state in which the pressure portion 231 and the extension/contraction portion 244 are elastically deformed due to an external force, when the external force is released, the pressure portion 231 and the extension/contraction portion 244 may be returned to its origin state by virtue of its own resilience.

The pumping member 220 may be made of an elastically compressible and expandable material. For example, the pumping member 220 may be made of a material such as rubber, silicone, or a synthetic resin.

In the example embodiment, the lower part 230 and the upper part 240 which constitute the pumping member 220 are separately provided and have a relatively simple structure as compared with the entire pumping member in which the lower part 230 and the upper part 240 are assembled. Thus, the lower part 230 and the upper part 240 of the pumping member 220 may be separately injection-molded. As an example, the lower part 230 and the upper part 240 may be fabricated by injection-molding with a 100% eco-friendly material used fora general-purpose cosmetic container.

In the case of a pumping member in which an upper part and a lower part are integrally connected to each other, the shape and structure of the pumping member are complicated. This makes it difficult to injection-mold the pumping member with an eco-friendly material used fora typical cosmetic container. As a result, deformation may occur due to interference between the cosmetic and the material of the pumping member, which may cause inconvenience of having to separate parts of the cosmetic container at the time of disposal.

The lower part 230 includes the pressure portion 231, the check valve 233, and the flange 232.

The pressure portion 231 varies the pressure of the internal space by compression and expansion based on its own elasticity with the driving of the discharge head 300. The compression portion 231 of the example embodiment is configured to be elastically deformed with the driving of the discharge head 300 to increase or decrease an axial length thereof.

Figure 4:
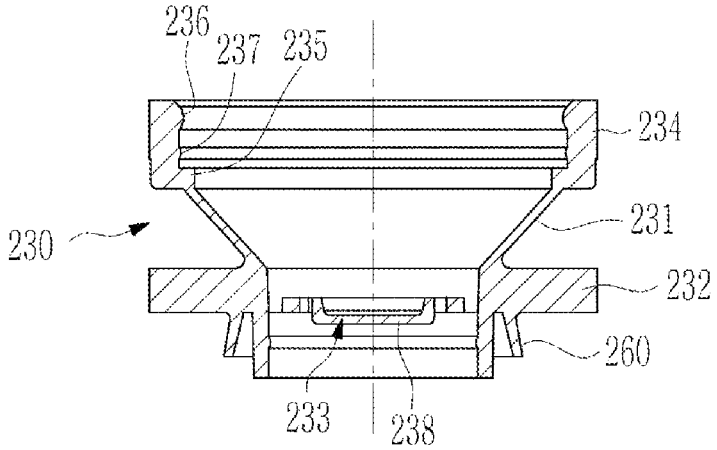
Figure 5:
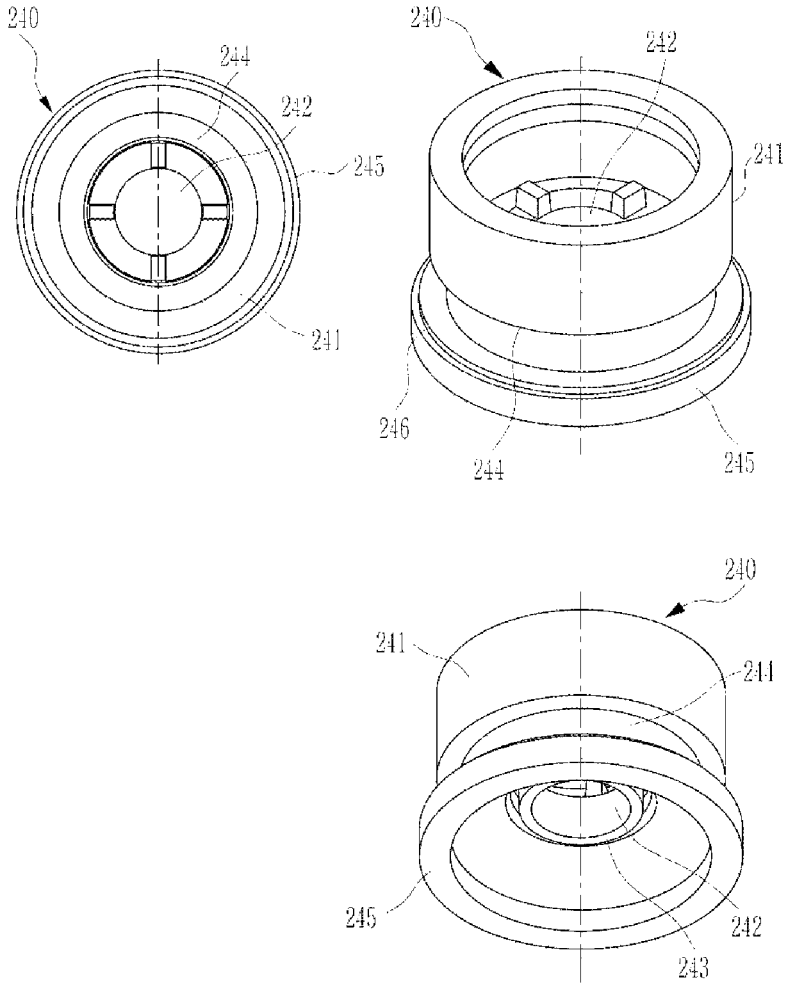

As illustrated in FIG. 4, the pressure portion 231 of the example embodiment may be formed to have a relatively thin thickness so as to be elastically deformable, and may be formed to have an inner diameter which becomes gradually smaller inward along the axial direction. Taking this into account, the injection-molding is more preferable. The internal space formed by the pressure portion 231 is in communication with the check valve 233 located immediately below the internal space. The contents introduced from the check valve 233 are accommodated in the internal space formed by the pressure portion 231.

When the inclined portion of the pressure portion 231 is elastically deformed, the internal space is compressed or expanded to vary the pressure. In this way, the pumping operation is implemented. The pressure portion 231 is compressed by an external force for pressing the discharge head 300 to apply a discharge pressure to the contents. When the external force is released, the pressure portion 231 returns to its original state by virtue of its own resilience to apply a suction pressure with respect to the contents in the container body 100.

When an external force is applied to the pumping member 220 with the driving of the discharge head 300, the force is transmitted to the pressure portion 231 and thus the pressure portion 231 is elastically deformed so that the internal space is compressed. As the pressure portion 231 is continuously compressed, the pressure of the internal space of the pressure portion 231 is increased. When the pressure of the internal space becomes larger than that of the container body 100, the check valve 233 comes into close contact with the hole 211. The contents pressurized by the pressure portion 231 are finally discharged to the discharge head 300 through the nozzle member 270.

When the external force applied to the pumping member 220 is released, the pressure portion 231 is expanded by virtue of its own resilience and returns to its original state. The pressure of the internal space becomes relatively lower than that of the container body 100 as the internal space of the pressure portion 231 expands. As a result, a gap between the check valve 233 and the hole 211 is expanded and opened so that the contents accommodated in the container body 100 are introduced into the internal space of the pressure portion 231 again and are filled into the internal space.

The check valve 233 is formed integrally inside the lower portion of the pressure portion 231 to cause the contents in the container body 100 to flow into the pressure portion 231 in one direction.

The check valve 233 is brought into close contact with or spaced apart from the hole 211 of the housing 210 by the pressure of the internal space of the pumping member 220 to perform opening or closing. In the example embodiment, the check valve 233 has a configuration in which a valve plate 238 covering the hole 211 is connected to a plurality of ribs 239. The valve plate 238 is moved to open or close the hole 211 as the plurality of ribs 239 is elastically compressed and expanded.

The check valve 233 is opened and closed with a change in the pressure of the internal space of the pumping member 220 to transfer the contents in merely a direction from the container body 100 toward the pumping member 220. That is, when the pressure of the internal space of the pumping member 220 is relatively low, the valve plate 238 of the check valve 233 opens the hole 211. Thus, the contents in the container body 100 flow from the hole 211 into the pumping member 220 through the check valve 233. Conversely, when the pressure of the internal space of the pumping member 220 is relatively high, the valve plate 238 is brought into close contact with the hole 211 due to the pressure exerted on the check valve 233, thus blocking the hole 211. This prevents the contents inside the pumping member 220 from being moved toward the container body 100.

The flange 232 is formed integrally with the lower portion of the pressure portion 231.

The flange 232 is formed to protrude outward from the outer circumferential surface of the pressure portion 231. The flange 232 functions as a stopper which is locked to the stepped portion 216 of the housing 210 so as to support the pumping member 220 to the housing 210. The flange 232 is brought into close contact with the stepped portion 216 of the housing 210.

The flange 232 may be brought into close contact with the stepped portion 216 of the housing 210 in a pressing manner by virtue of the resilience of the pumping member 220.

The upper part 240 includes the insertion portion 241, the blocking member 243, and the extension/contraction portion 244.

The insertion portion 241 constitutes the upper end of the pumping member 220 and is fitted into and coupled to the nozzle member 270. The insertion portion 241 may be provided to be in close contact with the nozzle member 270. The insertion portion 241 is in selective communication with the inner conduit 271 of the nozzle member 270.

The insertion portion 241 is formed in a cylindrical tube structure which extends along the axial direction to constitute the upper end portion of the pumping member 220. The nozzle member 270 is provided to be inserted into the insertion portion 241 through an opened upper end of the insertion portion 241. Uneven portions may be formed in an inner circumferential surface of the insertion portion 241 and an outer circumferential surface of the nozzle member 27 to be engaged with each other. Thus, the inner surface of the insertion portion 241 may be coupled to the outer surface of the nozzle member 270 while being brought into close contact with the outer surface of the nozzle member 270 in a pressing manner.

The blocking member 243 is formed inside the insertion portion 241.

The blocking member 243 is formed to extend in the axial direction at the center of the insertion portion 241 to form the passage 242 through which the contents are transferred. The blocking member 243 is configured such that a lower end thereof constitutes a free end to be elastically expanded outward and be increased in inner diameter.

The blocking member 243 is brought into close contact with a fitting portion 274 of the nozzle member 270, which is fitted into the passage 242, to selectively block between the pressure portion 231 and the inner conduit 271 of the nozzle member 270.

The blocking member 243 is brought into close contact with the fitting portion 274 of the nozzle member 270 in a resilient manner. This makes it possible to keep a gap between the pumping member 220 and the nozzle member 270 closed.

A gap between the blocking member 243 and the nozzle member 270 is opened or closed by the elastic deformation of the extension/contraction portion 244.

The extension/contraction portion 244 of the example embodiment is formed integrally with the lower portion of the insertion portion 241 and is configured to be elastically deformed with the driving of the discharge head 300 to increase or decrease the axial length thereof. The extension/contraction portion 244 varies the pressure of the internal space by being compressed or expanded by virtue of its own elasticity with the driving of the discharge head 300.

Figure 6:
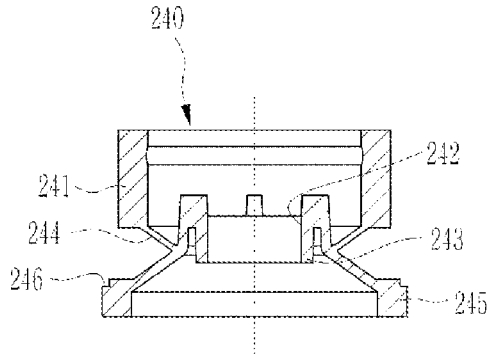

As illustrated in FIG. 6, the extension/contraction portion 244 of the example embodiment may be formed to have a relatively thin thickness so as to be elastically deformable, and may be formed to have an inner diameter which is gradually decreased as it goes inward along the axial direction. Taking this into account, the injection-molding is more preferable.

An upper portion of an internal space formed by the extension/contraction portion 244 is in communication with the passage 242 of the blocking member 243 positioned at the central portioner, and a lower portion thereof is in communication with the pressure portion 231 of the lower part 230. The contents in the pressure portion 231 move to the internal space formed by the extension/contraction portion 244.

An inclined portion of the extension/contraction portion 244 is elastically deformed to move the blocking member 243 upward, and compress or expand the internal space so as to vary a pressure of the internal space, thus opening or closing the gap between the blocking member 243 and the nozzle member 270.

The extension/contraction portion 244 is elastically compressed by the external force for pressing the discharge head 300 so that the blocking member 243 is moved upward. Thus, the blocking member 243 is moved relative to the fitting portion 274 of the nozzle member 270 so that an extended portion 276 formed in the fitting portion 274 is spaced apart from the blocking member 243 to form a gap therebetween. Further, the pressure of the internal space is increased by the compression of the extension/contraction portion 244 and an outer diameter of the blocking member 243 is elastically increased expanded so that the gap is expanded. Thus, the contents may be discharged to the nozzle member 270 through the expanded gap.

When the external force applied to the pumping member 220 is released, the extension/contraction portion 244, which was in the compressed state, returns to its original state by virtue of its own resilience, and the blocking member 243 is lowered to its original position so that the blocking member 243 is brought into close contact with the extended portion 276 formed in the fitting portion 274 of the nozzle member 270. Thus, the gap between the fitting portion 274 of the nozzle member 270 and the blocking member 243 is closed, which blocking the discharge of the contents.

In the example embodiment, the extension/contraction portion 244 is configured to have an elastic modulus relatively larger than that of the pressure portion 231. The extension/contraction portion 244 and the pressure portion 231 may are different in cross-sectional thickness to have different elastic moduli. For example, a cross-sectional thickness of the extension/contraction portion 244 may be formed thicker than that of the pressure portion 231 such that the elastic moduli of the extension/contraction portion 244 and the pressure portion 231 are different from each other.

With this configuration, when an external force is applied to the pumping member 220, the pressure portion 231 having a relatively low elastic modulus may be compressed and deformed earlier than the extension/contraction part 244. After the pressure portion 231 is elastically deformed, when the external force continues to be applied to the pumping member 220, the extension/contraction part 244 having a relatively high elastic modulus compared with the pressure portion 231 is compressed and deformed. The extension/contraction part 244 is compressed and deformed and the blocking member 243 is moved. As a result, a gap is formed between the fitting portion 274 of the nozzle member 270 and the blocking member 243. Thus, the contents which in a pressurized state by the pressure portion 231, are discharged to the nozzle member 270 through the gap.

Conversely, when the external force applied to the pumping member 220 is released, the extension/contraction portion 244 having a relatively high elastic modulus is first expanded and deformed by virtue of its own resilience and returns to its original state. As the extension/contraction portion 244 returns to its original state, the gap between the blocking member 243 and the nozzle member 270 is first blocked. After the extension/contraction portion 244 is returned to its original state, the pressure portion 231 is expanded and deformed by virtue of its own resilience and returns to its origin state. When the pressure portion 231 is expanded and deformed, a negative pressure is formed in the internal space. Since the gap between the blocking member 243 and the nozzle member 270 remains blocked, the contents in the container body 100 are caused to flow into the internal space of the pressure portion 231 through the check valve 233 by the negative pressure of the pressure portion 231. As described above, the pressure portion 231 and the extension/contraction portion 244 are sequentially driven so that the action of pumping the contents may be smoothly performed.

The nozzle member 270 may include: a nozzle body 272 in which the inner conduit 271 through which the contents are transferred is formed and which is fitted into and brought into close contact with the upper portion of the insertion portion 241 of the pumping member 220; a connection pipe 273 extending in the axial direction on an upper end of the nozzle body 272, in which the inner conduit 271 is formed and to which the discharge head 300 is coupled; the fitting portion 274 which is formed on a lower end of the nozzle body 272 and is inserted into the blocking member 243 of the insertion portion 241; an inflow hole 275 which is formed in a lateral surface of the fitting portion 274 to communicate the interiors of the inner conduit 271 and the insertion portion 241 with each other; and the extended portion 276 which is formed to protrude outward from the lower end of the fitting portion 274 and is brought into close contact with the inner surface of the blocking member 243 to block between the insertion portion 241 and the extension/contraction portion 244.

The nozzle member 270 is positioned in the operation chamber 212 which is located in the upper portion in the housing 210. The upper end of the nozzle member 270 is connected to the discharge head 300 and the lower end thereof is coupled to the pumping member 220. The inner conduit 271 through which the contents are transferred is formed inside the nozzle member 270. The nozzle member 270 compresses the pumping member 220 with the operation of the discharge head 300 to selectively open or close between the inner conduit 271 and the internal space of the pumping member 220.

The nozzle member 270 is coupled to the insertion portion 241 formed in the upper portion of the pumping member 220 so as to connect the pumping member 220 and the discharge head 300. The nozzle member 270 forms a movement passage through which the contents are moved using the inner conduit 271 formed therein. The inner conduit 271 communicates with the outlet 320 through the interior of the discharge head 300.

The nozzle member 270 applies a driving force of the discharge head 300 to the pumping member 220 so as to compress the pumping member 220, and open or close the blocking member 243 of the extension/contraction portion 244.

The connection pipe 273 is a tube structure formed integrally with the nozzle body 272 and extending upward. The conduit of the nozzle body 272 is formed to extend to the interior of the connection pipe 273. The discharge head 300 is fitted into and coupled to the connection pipe 273. The inner conduit 271 of the connection pipe 273 is connected to the outlet 320 of the discharge head 300.

The nozzle body 272 is formed in a cylindrical shape having a diameter corresponding to the insertion portion 241. The nozzle body 272 may be inserted into the insertion portion 241 in a pressing manner so as not to be separated outward. For example, uneven portions are formed on the inner circumferential surface of the insertion portion 241 and the outer circumferential surface of the nozzle body 272, respectively. Thus, the insertion portion 241 and the nozzle body 272 may be engaged with each other through the uneven portions and are fixed to each other.

The fitting portion 274 is formed to extend integrally at the center of the lower end of the nozzle body 272, and is fitted into and brought into close contact with the blocking member 243 of the insertion portion 241. The inner conduit 271 is also formed inside the fitting portion 274.

The inflow hole 275 may be formed in the lateral surface of the fitting portion 274. At least one of inflow hole 275 may be formed along the outer circumferential surface of the fitting portion 274. Thus, the contents introduced between the blocking member 243 and the fitting portion 274 may be moved to the inner conduit 271 through the inflow hole 275.

The extended portion 276 is formed to protrude outward on the outer circumferential surface of the lower end of the fitting portion 274. The extended portion 276, which is a portion having an outer diameter relatively larger than that of the fitting portion 274, is brought into close contact with the blocking member 243 to block the gap.

As described above, when the extension/contraction portion 244 is elastically deformed into a compressed state with the driving of the discharge head 300, the blocking member 243 is moved upward with respect to the extended portion 276 whose position is relatively fixed, so that the gap is generated between the blocking portion 243 and the extended portion 276. Thus, the contents inside the extension/contraction portion 241 may be moved to the inner conduit 271 of the nozzle member 270 through the gap.

Figure 7:
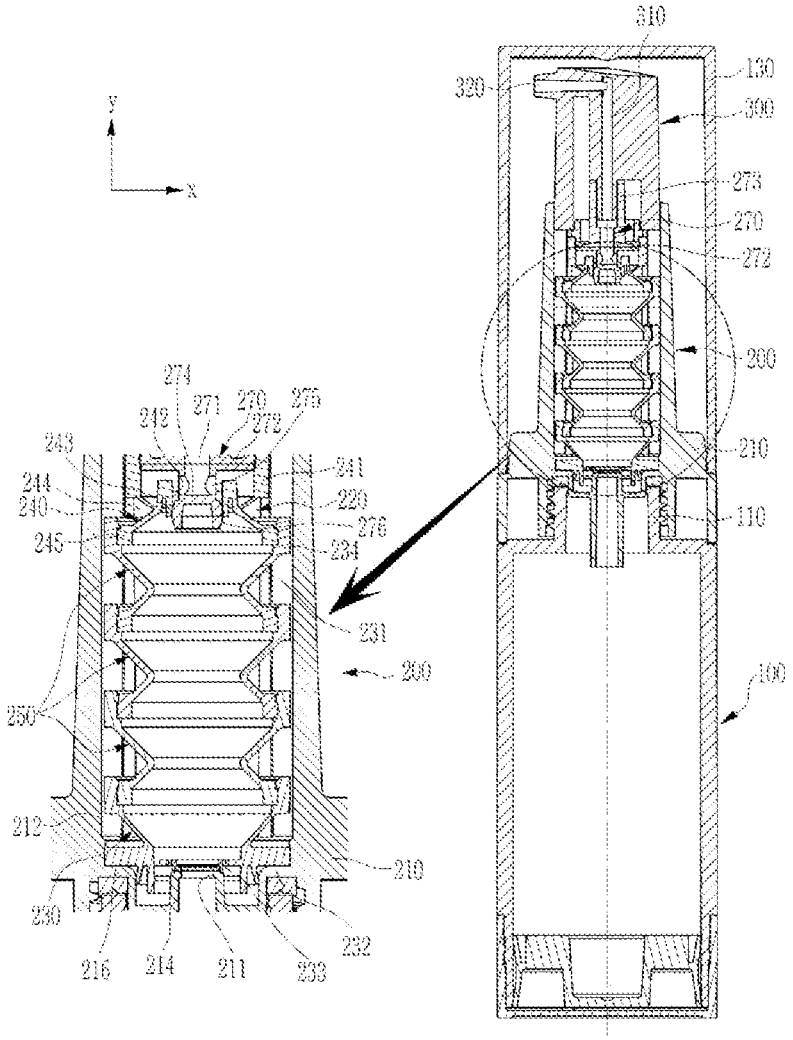
FIGS. 7 to 10 are cross-sectional views illustrating a cosmetic container according to another example embodiment of the present disclosure, respectively.
Figure 8:
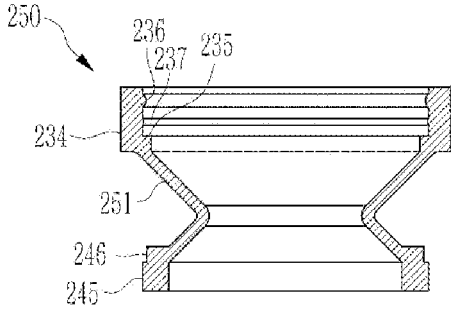

FIG. 7 illustrates a cosmetic container according to another example embodiment, and FIG. 8 illustrates a structure of an intermediate part 250.

The cosmetic container of another example embodiment described with reference to FIGS. 7 and 8 below is similar to the cosmetic container of the above-described example embodiment except that the pumping member 220 is configured to further include the intermediate part 250. Thus, the same constituent element will be denoted by the same reference numerals and detailed description thereof will be omitted. Hereinafter, the intermediate part 250 of the pumping member 220 will be described in detail.

As illustrated in the figures, the pumping member 220 of the example embodiment may further include at least one intermediate part 250 which is stacked between the upper part 240 and the lower part 230.

The intermediate part 250 has a cylindrical shape in which an internal space is formed and at which upper and lower ends are opened, and connects the upper part 240 and the lower part 230.

The ring portion 245, which is fitted into and coupled to the groove portion 234 of the lower part 230, is formed on the lower end of the intermediate part 250. The groove portion 234 into and to which the ring portion 245 is fitted and coupled, is formed in the upper end of the intermediate part 250. A deformable portion 251, which is compressed and elastically restored by an external force to vary a pressure of the internal space, may be formed between the ring portion 245 and the groove portion 234.

The structure of the ring portion 245 formed in the intermediate part 250 is the same as the ring portion 245 formed in the upper part 240. Thus, the ring portion 245 of the intermediate part 250 may be mounted in the groove portion 234 of the lower part 230 as well as the groove portion 234 of another intermediate part.

The structure of the groove portion 234 formed in the intermediate part 250 is also the same as the groove portion 234 formed in the lower part 230. Thus, the ring portion 245 of the upper part 240 may be fitted into the groove portion 234 of the intermediate part 250 as well as the ring portion 245 of another intermediate part.

The deformable portion 251 may be configured to be elastically deformed with the driving of the discharge head 300 to vary an axial length thereof.

The deformable portion 251 may act as the pressure portion 231 of the lower part 230. With the driving of the discharge head 300, the deformable portion 251 varies the pressure of the internal space by being deformed by compression and expansion based on its own elasticity like the pressure portion 231.

As illustrated in FIG. 8, the deformable portion 251 of the example embodiment may have a relatively thin thickness so as to be elastically deformable, and may have an inclined portion which is obliquely formed such that an inner diameter thereof is gradually decreased inward along the axial direction. Thus, the injection-molding may be more easily implemented.

The internal space formed by the deformable portion 251 is in communication with the interior of the lower part 230 located just below the deformable portion 251 or another stacked intermediate part 250.

When the inclined portion of the deformable portion 251 is elastically deformed, the deformable portion 251 compresses or expands the internal space to vary the pressure of the internal space, thus performing a pumping operation. The overall up-down stroke of the pumping member 220 may be increased by the intermediate part 250.

FIG. 7 exemplarily illustrates the pumping member 220 in which at least one intermediate part 250 is sequentially stacked one above another between the lower part 230 and the upper part 240. The number of stacked intermediate parts 250 is not limited to three but may be two or more. The overall up-down stroke of the pumping member 220 may be varied depending on the number of stacked intermediate parts 250.

In this configuration, a plurality of intermediate parts 250 may be properly stacked to be suitable for various cosmetic containers from which amounts of discharged contents are different, which makes it possible to vary at various levels the up-down stroke of the pumping member 220, that is, the amounts of discharged contents.

Accordingly, it is possible to provide a pumping member capable of discharging a desired amount of contents by stacking an appropriate number of intermediate parts without having to manufacture a separate pumping member corresponding to the type or size of a cosmetic container, an amount of contents to be discharged, or the like.

Figure 9:
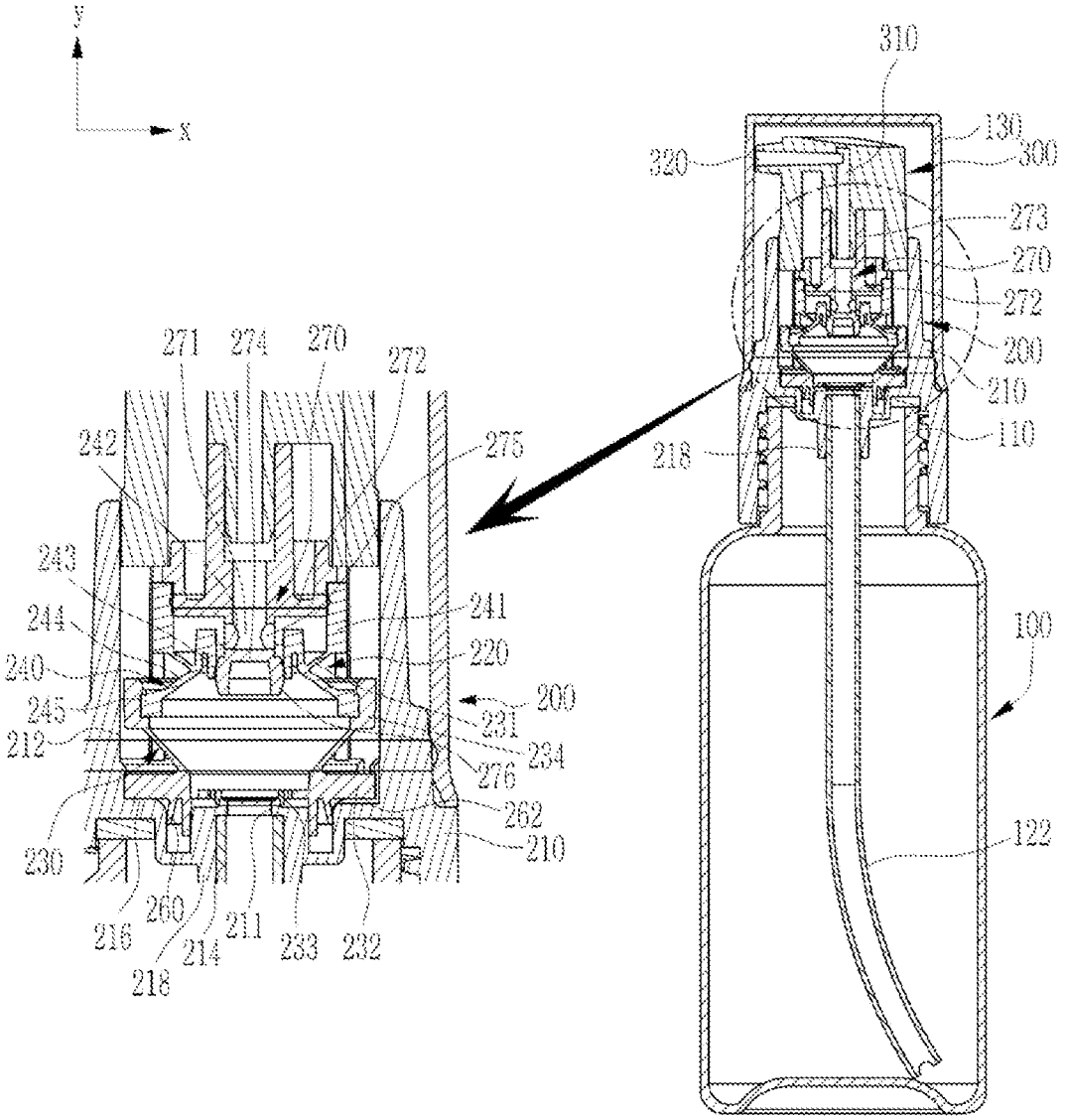

FIG. 9 illustrates a cosmetic container according to another example embodiment.

The cosmetic container according to another example embodiment described with reference FIG. 9 is similar to the cosmetic container according to the example embodiment described above except for a configuration in which the contents are discharged through the inflow tube 122. Thus, the same constituent element will be denoted by the same reference numerals and detailed description thereof will be omitted.

As illustrated in FIG. 9, the cosmetic container may further include the inflow tube 122 connected to the pumping device 200 and extending toward the inner bottom of the container body 100 to allow the contents to flow thereinto.

The inflow tube 122 has an empty hollow tube structure such that the contents may be moved therethrough. The inflow tube 122 may be connected to the pumping device 200 to extend lengthwise to the inner bottom of the container body 100. For example, the inflow tube 122 may be fitted into a support pipe 218 formed in the housing 210 to extend downward so as to communicate with the hole 211.

With the driving of the pumping device 200, the contents are suctioned into the inflow tube 122 and are moved to the pumping member 220 through the hole 211 of the housing 210.

Further, the cosmetic container of the example embodiment is configured such that ambient air is allowed to flow into the container body 100 as the contents are discharged.

To do this, the cosmetic container of the example embodiment may further include a skirt portion 260 which is formed integrally with the lower portion of the pressure portion 231 to extend downward. The skirt portion 260 has an outer diameter that is increased as it goes downward so that the skirt portion 260 is brought into close contact with the inner surface of the cylinder chamber 214 of the housing 210 in an elastic manner.

The skirt portion 260 selectively opens or closes the cylinder chamber 214 if necessary. By the skirt portion 260, the ambient air is allowed to flow into and filled into the container body 100. As a result, the empty space of the container body 100 is filled with the ambient air as the contents in the container body 100 are discharged. Thus, an internal pressure of the container body 100 becomes approximately the same as atmospheric pressure so that the form of the container body 100 may be maintained constant.

The skirt portion 260 is formed continuously along an outer circumferential surface of the lower end of the pressure portion 231. The skirt portion 260 may have a structure whose outer diameter becomes larger toward the lower end. The skirt portion 260 may be smaller in thickness toward the lower end so as to be more smoothly deformed. With this structure, the tip end of the skirt portion 260 may be easily elastically deformed outward to be brought into close contact with the inner surface of the cylinder chamber 214 of the housing 210. This makes it possible to prevent the contents in the container body 100 from leaking through a gap between the skirt portion 260 and the cylinder chamber 214. Further, the tip end of the skirt portion 260 may be easily elastically deformed inward to form the gap between the skirt portion 260 and the inner surface of the cylinder chamber 214 of the housing 210. This makes it possible to allow the ambient air to flow into the container body 100 through the gap between the skirt portion 260 and the cylinder chamber 214.

When the internal pressure of the container body 100 is relatively larger than the external pressure, the skirt portion 260 is brought into more close contact with the inner surface of the cylinder chamber 214 of the housing 210 while being expanded outward. Thus, when the pumping member 220 is in a compressed state or when the container body 100 is pressed so that the internal pressure is increased, the skirt portion 260 is brought into close contact with the cylinder chamber 214 of the housing 210 to block the gap. This prevents the contents from flowing out of the housing 210.

Conversely, when the contents in the container body 100 flow into the pumping member 220 as the check valve 233 is opened with the operation of the pumping member 220, the internal pressure of the container body 100 becomes smaller than the external pressure.

As a result, due to such a pressure difference, the ambient air in a relatively high pressure flows into the container body 100 in a relatively low pressure, and the skirt portion 260 is elastically deformed inward so that the gap between the inner surface of the cylinder chamber 214 of the housing 210 and the skirt portion 260 is expanded. Thus, the ambient air may flow into the housing 210 and flow into the container body 100 through the gap between the skirt portion 260 and the inner surface of the cylinder chamber 214.

The ambient air is introduced into the container body 100 and is filled into the internal space of the container body 100 from which the contents was discharged. Thus, the container body 100 may be maintained at its original state without causing buckles.

As described above, it is possible to fully prevent the contents from flowing out of the container body 100 and allow the ambient air to flow into the container body 100 in a more simplified configuration and a relatively simple manner using the skirt portion 260 formed integrally with the pumping member 220.

The pumping device 200 of the example embodiment is configured such that the ambient airflows into the container body 100 in a relatively smooth manner. To do this, at least one trench 262 for allowing air to flow therethrough may be further formed in the stepped portion 216 of the housing 210, which is in contact with the flange 232 of the pumping member 220.

A gap is formed between the stepped portion 216 and the flange 232 by the trench 262 to allow the air to flow therethrough.

The trench 262 may be formed to be depressed in a horizontal surface of the stepped portion 216 in contact with the flange 232 of the pumping member 220. A plurality of trenches 262 may be formed at an interval along the circumferential direction. By the trench 262, the gap may be formed between the horizontal surface of the stepped portion 216 and the flange 232 which have been brought into close contact with each other. The gap may act as an air introduction passage.

Furthermore, like the other example embodiments described above, even in the cosmetic container of the example embodiment with the inflow tube 122 illustrated in FIG. 9, the pumping member 220 may further include at least one intermediate parts 250 which is stacked one above another between the upper part 240 and the lower part 230.

Figure 10:
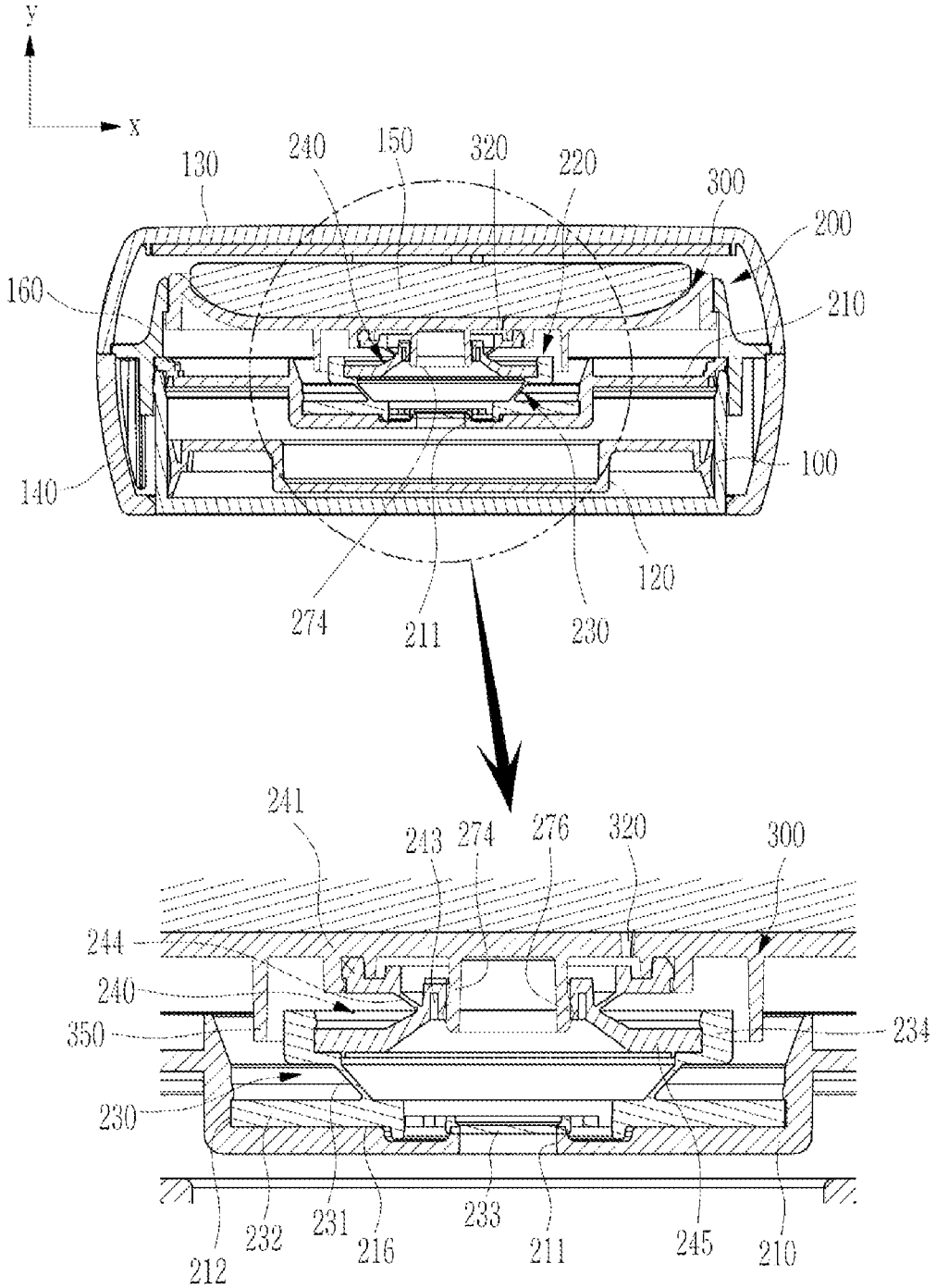

FIG. 10 illustrates a cosmetic container of a compact structure in which a powder or the like is received, according to still another example embodiment.

Constituent elements of the cosmetic container of still another example embodiment described with reference to FIG. 10 below are similar in structure and operation to those in the example embodiments described above except that the shape of each constituent element is modified to meet a compact structure of a flat form. Thus, the same constituent element will be denoted by the same reference numerals and detailed description thereof will be omitted.

As illustrated in FIG. 10, the cosmetic container of the example embodiment may include: a container body 100 in which contents are accommodated; a pumping device 200 coupled to an opened upper end of the container body 100 and configured to discharge the contents accommodated in the container body 100 by a pumping operation based on its own elasticity; a discharge head 300 connected to the pumping device 200 to apply a discharge pressure to the pumping device 200 and having an outlet 320 formed in one side to communicate with the pumping device 200 and through which the contents are discharged; a piston member 120 located inside the container body 100 and configured to move with the discharge of the contents; a lower case 140 configured to enclose the container body 100; and an upper cap 130 rotatably mounted to the lower case 140 to cover the discharge head 300.

The cosmetic container of the example embodiment may further include a shoulder portion 160 provided on an upper end of the lower case 140 and configured to guide the discharge head 300 upward and downward. The shoulder portion 160 has a cylindrical shape whose upper and lower end are opened. The lower end of the shoulder portion 160 is fixedly installed to the lower case 140, and the upper end thereof is formed to extend upward. The discharge head 300 is guided upward and downward while being fitted into an inner surface of the shoulder portion 160.

Further, the pumping device 200 may include: a housing 210 which is brought into close contact with the opened upper end of the container body 100 and has a hole 211 formed in the central portion of the housing 210 to communicate with the interior of the container body 100; a pumping member 220 provided inside the housing 210 to be connected to the hole 211 of the housing 210 and having a content accommodation space defined therein, wherein the pumping member 220 is elastically compressed or expanded along an axial direction to transfer the contents in one direction along the axial direction; and a nozzle head 270 formed integrally with a lower end of the discharge head 300.

Figure 11:
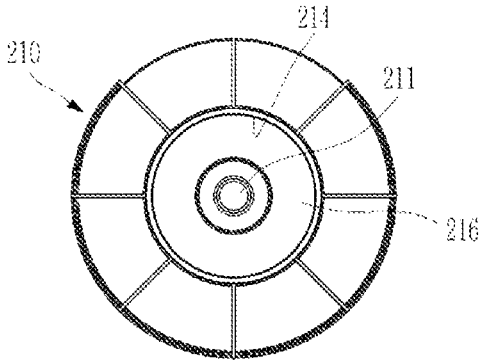
FIGS. 11 to 14 are views illustrating constituent elements of the cosmetic container according to the example embodiment of FIG. 10, respectively.
Figure 11:
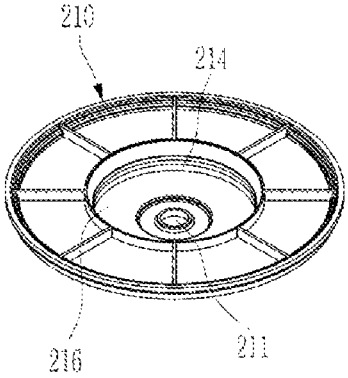
Figure 11:
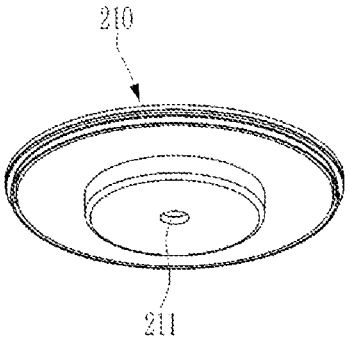
Figure 12:
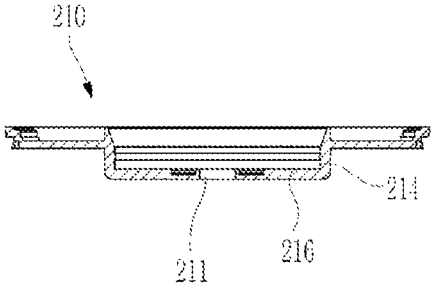

FIGS. 11 and 12 illustrate the housing 210 of the example embodiment.

The housing 210 of the example embodiment may be a circular plate structure provided on the upper end of the container body 100. The hole 211 is formed in the central portion of the lower end of the housing 210 to be in communication with the container body 100.

A cylinder chamber 214 may be concavely formed in the central portion of the housing 210 to have different inner diameters along the axial direction. The hole 211 is formed in the center of the cylinder chamber 214, and a stepped portion 216 is formed on the bottom surface of the cylinder chamber 214. A flange 232 formed at the lower portion of the pumping member 220 may be brought into contact with and fixed to the stepped portion 216.

Figure 13:
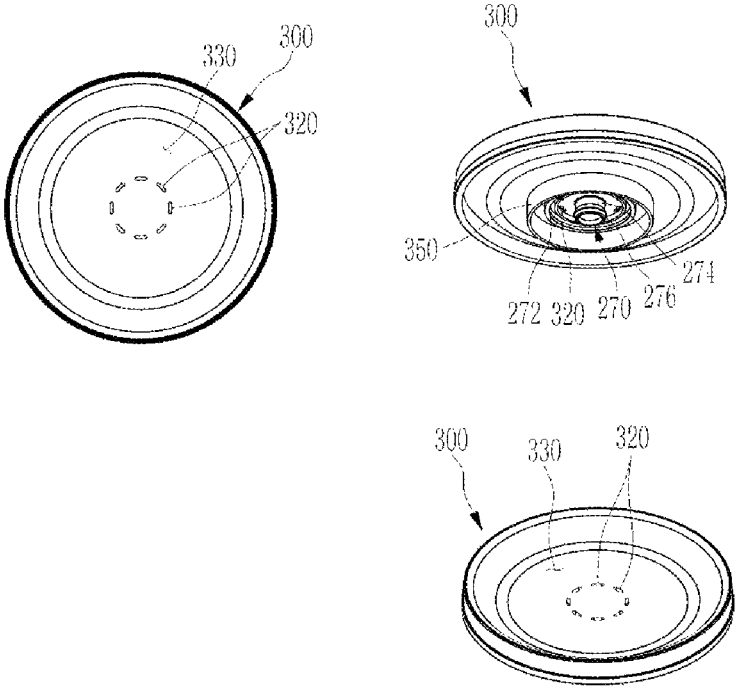
Figure 14:
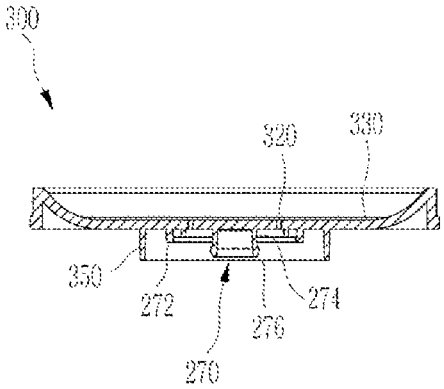

FIGS. 13 and 14 illustrate the discharge head 300 of the example embodiment, respectively.

The discharge head 300, which is a circular structure, may be fitted into the inner circumferential surface of the shoulder portion 160 to be movable upward and downward. A downwardly-depressed concave portion 330 is formed in an upper surface of the discharge head 300. A makeup puff 150 may be placed in the concave portion 330.

A plurality of outlets 320 from which the contents are discharged may be formed at an interval in the central portion of the discharge head 300. The outlets 320 are in communication with the pumping member 200 to discharge the contents to the concave portion 330.

The discharge head 300 of the example embodiment may be a structure formed integrally with the nozzle member 270. This makes it easy to manufacture the discharge with a reduced number of parts, and makes it possible to reduce the inconvenience of separately manufacturing and assembling the discharge head and the nozzle member.

A nozzle body 272 and a fitting portion 274 of the nozzle member 270 may be formed integrally with the lower portion of the discharge head 300. The nozzle body 272 may have a cylindrical shape. The insertion portion 241 of the pumping member 220 may be fitted into and coupled to the nozzle body 272. An extended portion 276 may be formed on an outer circumferential surface of a lower end of the fitting portion 274 so as to be brought into close contact with a blocking member 243 of the pumping member 220.

A cylindrical stopper member 350 may be formed outside the nozzle body 272 to extend downward on the lower end of the discharge head 300. The stopper member 350 is lowered as the discharge head 300 is pressed and is brought into contact with the flange 232 fitted into the stepped portion 216 of the housing 210, which makes it possible to limit a range of stroke of the discharge head 300.

Figure 15:
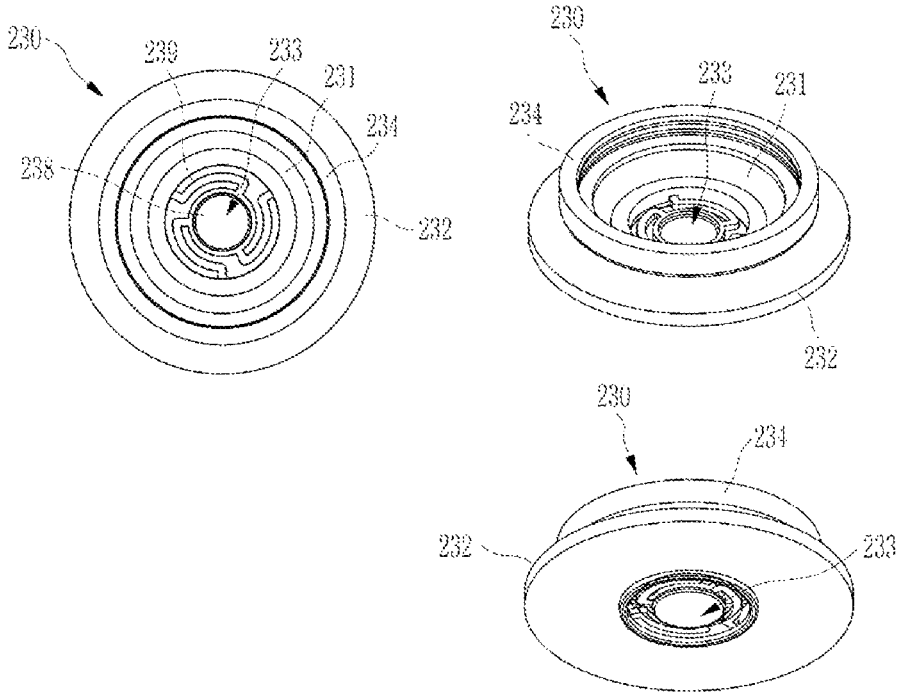
FIGS. 15 to 18 are views illustrating constituent elements of a pumping member according to the example embodiment of FIG. 10, respectively.
Figure 16:
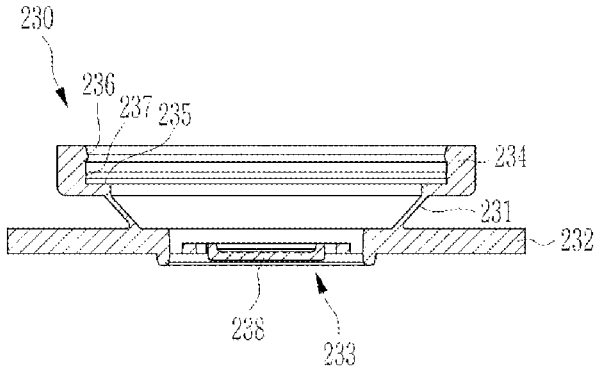
Figure 17:
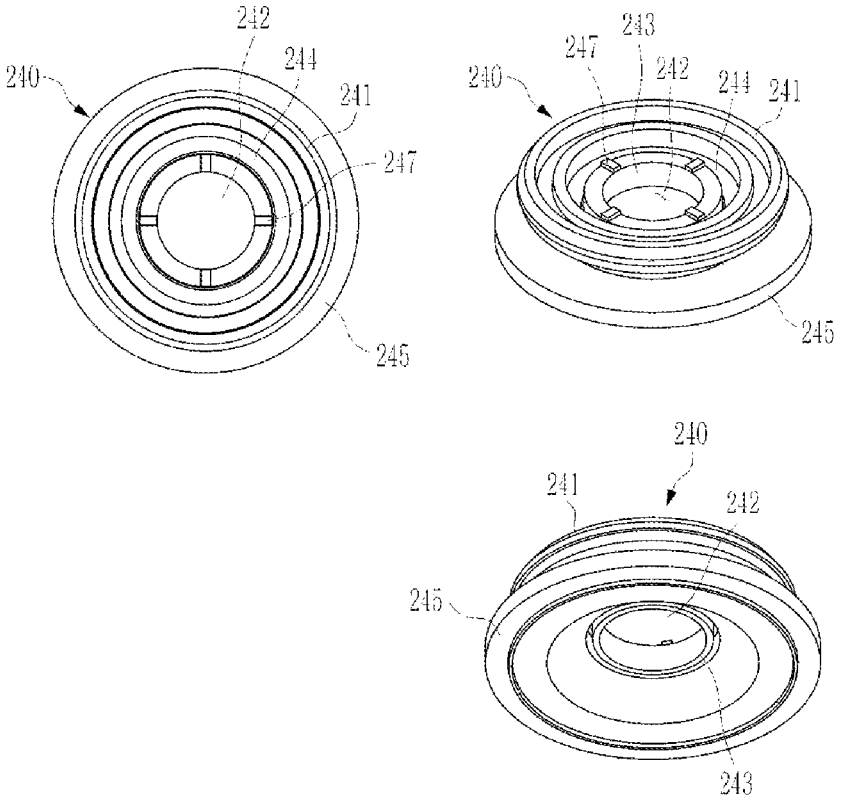
Figure 18:
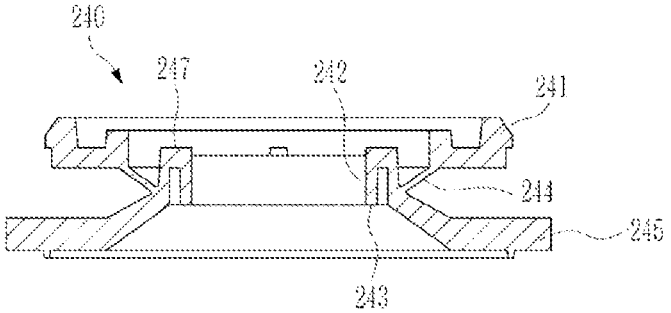

FIGS. 15 and 16 illustrate lower parts applied to the cosmetic container having a compact structure, respectively, and FIGS. 17 and 18 illustrate upper parts, respectively.

The upper part 240 and the lower part 230 which constitute the cosmetic container having a compact structure are different in shape from each other, but structures and operations/effects thereof are the same as those of the upper part and the lower part described above. Thus, the same constituent element will be denoted by the same reference numerals and detailed description thereof will be omitted.

In the cosmetic container of the example embodiment, the nozzle member 270 is formed integrally with the discharge head 300 so that the upper part 240 may be directly connected to the lower end of the discharge head 300.

As shown in FIGS. 17 and 18, the insertion portion 241 of the upper part 240 is fitted into and brought into close contact with the nozzle body 272 of a circular tube shape formed on the lower end of the discharge head 300.

When the insertion portion 241 of the upper part 240 is fitted into and coupled to the nozzle body 272, the fitting portion 274 formed in the discharge head 300 is inserted into the passage 242 and is brought into close contact with the inner surface of the blocking member 243. Further, the outlet 320 formed in the discharge head 300 communicates with the internal space of the insertion portion 241.

In this configuration, when the discharge head 300 is pressed, the pumping member 220 is compressed and the contents are discharged upward from the discharge head 300 through the outlet 320 in communication with the internal space of the insertion portion 241.

Further, protrusions 247 may be formed at an interval along the circumferential direction on the upper end of the blocking member 243 to protrude upward.

When the blocking member 243 rises upward as the pumping member 220 is compressed, the protrusions 247 are brought into contact with the lower surface of the discharge head 300 so that the upper end of the blocking member 243 and the lower surface of the discharge head 300 are spaced apart from each other.

As a result, a gap is formed between the upper end of the blocking member 243 and the lower end of the discharge head 300, and the contents allows to smoothly flow to the outlet 320 through the gap.

Although not shown in the figures, in the example embodiment of FIG. 10, at least one intermediate part may be further stacked one above another between the upper part and the lower part of the pumping member. Depending on the type of cosmetic container, the at least one intermediate part may be stacked between the upper part and the lower part as needed to vary the stroke of the pumping member and an amount of contents to be discharged from the pumping member.

FIGS. 19 to 22 illustrate a cosmetic container according to yet another example embodiment, respectively.

The cosmetic container of yet another example embodiment described with reference to FIGS. 19 to 22 below is similar to the cosmetic container of the example embodiments described above except for a configuration in which an auxiliary check valve 280 is additionally provided in the nozzle member 270 to ensure airtightness. Thus, the same constituent element will be denoted by the same reference numerals and detailed description thereof will be omitted.

Figure 19:
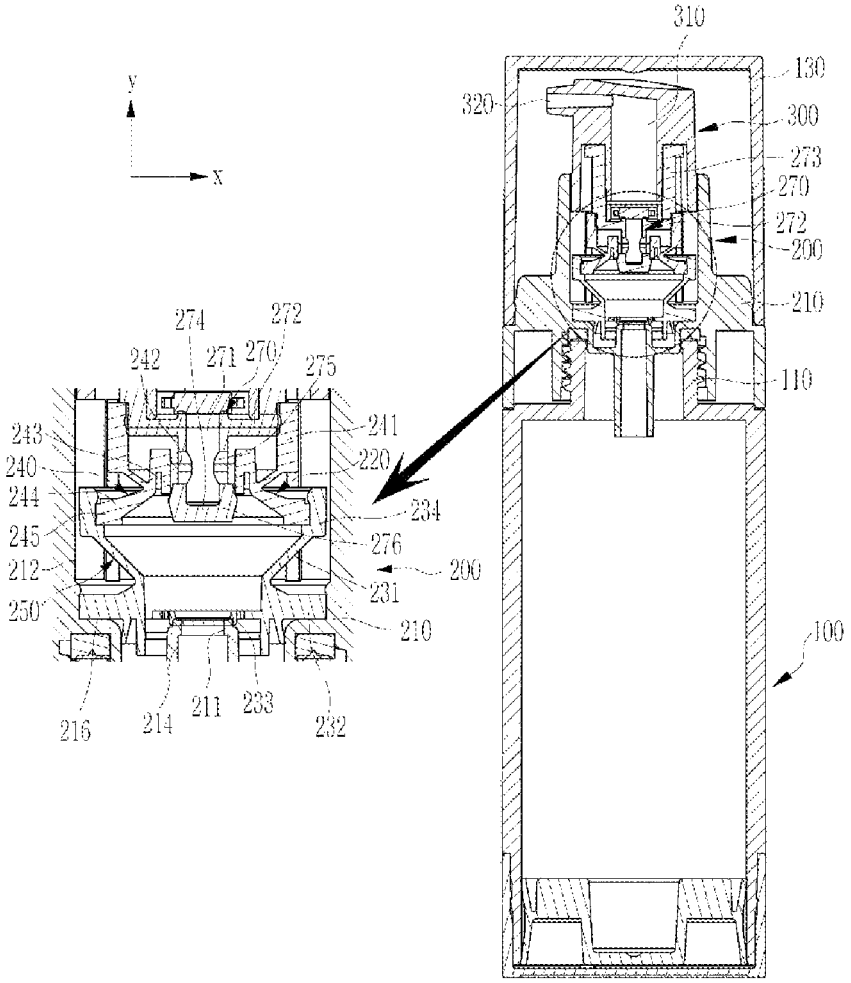
FIGS. 19 to 22 illustrate a cosmetic container according to still another example embodiment of the present disclosure, respectively.

FIG. 19 illustrates the configuration in which the auxiliary check valve 280 is provided in the cosmetic container of the example embodiment illustrated in FIG. 1.

As illustrated in FIG. 19, the cosmetic container of the example embodiment may have a configuration in which the auxiliary check valve 280 is provided on the inner conduit 271 of the nozzle member 270 to block the inner conduit 271 and to discharge the contents toward the discharge head 300 in one direction.

The auxiliary check valve 280 may be provided inside the connection tube 273 of the nozzle body 272 in which the inner conduit 271 is formed. The auxiliary check valve 280 is formed to have a size corresponding to the inner surface of the connection tube 273 to be brought into close contact with the connection tube 273.

An inner diameter of the connection tube 273 of the example embodiment is set to such a magnitude that the auxiliary check valve 280 may be sufficiently inserted into the connection tube 273. A stepped portion on which the auxiliary check valve 280 is placed, may be formed in an inner lower end of the connection tube 273. The shape of the discharge head 300 which is coupled to the nozzle member 270, may also be suitably modified in conformity to the structure of the nozzle member 270.

Thus, the auxiliary check valve 280 may be tightly provided between the stepped portion inside the connection tube 273 and the lower end of the discharge head 300 which is fitted into the connection tube 273 in a pressing manner.

Figure 20:
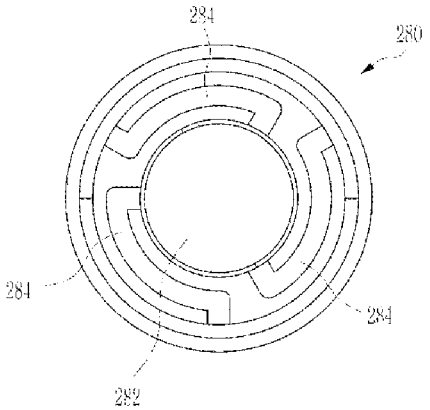

FIG. 20 illustrates a structure of the auxiliary check valve 280 provided on the inner conduit 271 of the nozzle member 270. As illustrated in FIG. 20, the auxiliary check valve 280 is brought into close contact with or spaced apart from the upper end of the inner conduit 271 formed in the central portion of the connection pipe 273. In this way, the opening and closing of the auxiliary check valve 280 is performed. The auxiliary check valve 280 is configured such that a valve plate 282 for closing the inner conduit 271 is connected to a plurality of ribs 284. When the plurality of ribs 284 is elastically extended or contracted to move the valve plate 282, the inner conduit 271 is opened or closed.

The auxiliary check valve 280 is opened or closed according to a change in pressure of the internal space of the pumping member 220 to transfer the contents from the pumping member 220 toward the discharge head 300 in one direction. That is, when the pressure of the internal space of the pumping member 220 is relatively high, the valve plate 282 of the auxiliary check valve 280 is lifted up to open the inner conduit 271. As a result, the contents in the pumping member 220 flow into the discharge head 300 through the inner conduit 271. Conversely, when the pressure of the internal space of the pumping member 220 becomes relatively smaller, the valve plate 282 of the auxiliary check valve 280 is brought into close contact with the upper end of the inner conduit 271 to block the inner conduit 271. This prevents the ambient air from moving from the discharge head 300 toward the pumping member 220.

As described above, by additionally providing the auxiliary check valve 280 on the inner conduit 271 of the nozzle member 270, it becomes possible to block the outflow of the contents and more efficiently prevent the inflow of the ambient air.

Figure 21:
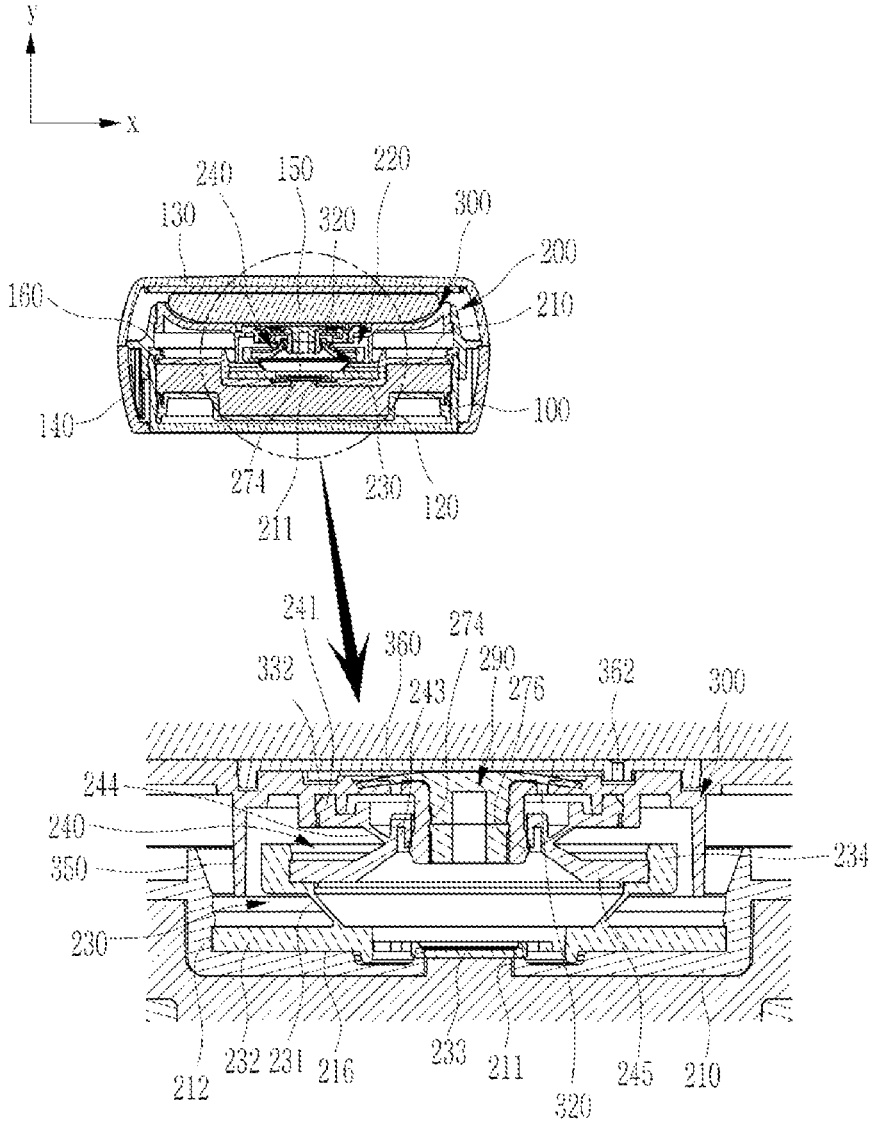

FIG. 21 illustrates a configuration in which an auxiliary check valve 290 according to another example embodiment is provided in the cosmetic container having a compact structure for receiving a powder or the like, as illustrated in FIG. 10.

As illustrated in FIG. 21, the cosmetic container of the example embodiment may be configured such that the auxiliary check valve 290 is provided in the fitting portion 274 of the discharge head 300 to block the outlet 320 and to discharge the contents toward the discharge head 300 in one direction.

The auxiliary check valve 290 may be configured to be coupled to the fitting portion 274 and brought into close contact with the upper end of the outlet 320 so as to selectively block the outlet 320.

The discharge head 300 may be depressed in a groove shape to form a mounting groove 332 so that the auxiliary check valve 290 may be provided at the central portion of the concave portion 330, that is, in the vicinity of the outlet 320. The mounting groove 332 and the fitting portion 274 are formed to be in communication with each other. Thus, the auxiliary check valve 290 is mounted to the fitting portion 274 outside the concave portion 330 so that the auxiliary check valve 290 may be positioned in the mounting groove 332. Therefore, the auxiliary check valve 290 may open or close the outlet 320 formed to penetrate through the concave portion 330.

The shape or size of the mounting groove 332 formed in the discharge head 300 of the example embodiment may be appropriately changed according to the auxiliary check valve 290.

A cover 360 for covering and protecting the auxiliary check valve 290 may further be provided on the mounting groove 332. The cover 360, which is a plate structure provided on the mounting groove 332, may be provided on the mounting groove 332 to form a bottom surface of the concave portion 330. A hole 362 may be formed in a surface of the cover 360 to be in communication with an internal space of the mounting groove 332. The contents discharged through the outlet 320 may be discharged upward from the concave portion 330 through the hole 362.

The cover 360 of the example embodiment may be detachably coupled to the mounting groove 332. Various kinds of covers 360 in which shapes of the hole 362 are different, may be provided. By mounting the various kinds of covers 360 according to cosmetic contents or user's needs in this way, modes and conditions of discharging the contents may be implemented in different fashions.

Figure 22:
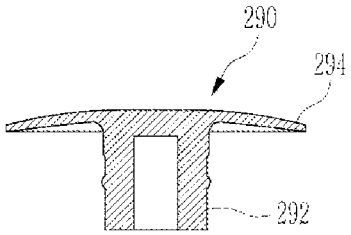

FIG. 22 illustrates a structure of the auxiliary check valve 290 provided in the mounting groove 332. As illustrated in FIG. 22, the auxiliary check valve 290 includes a shaft portion 292 which is fitted into the fitting portion 274 and a lid 294 which extends outward on an upper end of the shaft portion 292 to cover the outlet 320. The lid 294 may be configured to elastically move upward or downward so as to be in close contact with or spaced apart from the upper end of the outlet 320. In this way, the outlet 320 is opened or closed.

The shaft portion 292 may be formed to have a diameter corresponding to an inner diameter of the fitting portion 274, and may be brought into close contact with the inner surface of the fitting portion 274 so that the shaft portion 292 and the fitting portion 274 may be coupled to each other in an airtight relationship.

The lid 294 is formed to be expanded outward while being formed integrally with the upper end of the shaft portion 292. The lid 294 may be elastically deformed to be lifted up by an external force to open the outlet 320.

In addition to the above-described structure, the auxiliary check valve may be configured as the check valve provided with the ribs and the valve plate described above. Similarly, the check valve having such a configuration may be provided in the mounting groove 332 so that the valve plate may open or close the outlet 320 to discharge the contents in one direction. An internal shape of the mounting groove 332 may be properly deformed depending on the structure of the check valve.

As described above, the auxiliary check valve 290 is opened or closed depending on the change in pressure of the internal space of the pumping member 220 so as to transfer the contents from the pumping member 220 toward the discharge head 300. That is, when the pressure of the internal space of the pumping member 220 is relatively high, the lid 294 of the auxiliary check valve 290 is lifted up and the outlet 320 is opened. As a result, the contents in the pumping member 220 flow into the mounting groove 332 through the outlet 320 of the discharge head 300. Subsequently, the contents are discharged to the concave portion 330 through the hole 362 of the cover 360 provided in the mounting groove 332. Conversely, when the pressure of the internal space of the pumping member 220 is relatively low, the lid 294 of the auxiliary check valve 290 is brought into close contact with the upper end of the outlet 320 to close the outlet 320. This prevents the ambient air from moving from the discharge head 300 toward the pumping member 220.

In the example embodiment, the auxiliary check valve 290 is additionally provided on the outlet 320 of the discharge head 300. Therefore, it is possible to block the outflow of the contents and more efficiently prevent the inflow of the ambient air.

While exemplary embodiments of the present disclosure have been illustrated and described as described above, various modifications and other embodiments may be made by those skilled in the art. Such modifications and other embodiments are all contemplated and included in the appended claims without departing from the spirit and scope of the present disclosure.

REFERENCE NUMERALS

| | | | |
|---|---|---|---|
| 100: | Container body | 110: | Opening |
| 120: | Piston member | 122: | Inflow tube |
| 130: | Upper cap | 140: | Lower case |
| 150: | Puff | 160: | Shoulder portion |

-continued

| REFERENCE NUMERALS | | | |
|---|---|---|---|
| 100: | Pumping device | 210: | Housing |
| 211: | Hole | 212: | Operation chamber |
| 214: | Cylinder chamber | 216: | Stepped portion |
| 218: | Support pipe | 220: | Pumping member |
| 230: | Lower part | 231: | Pressure portion |
| 232: | Flange | 233: | Check valve |
| 234: | Groove portion | 235: | Lower stepped portion |
| 240: | Upper part | 241: | Insertion portion |
| 242: | Passage | 243: | Blocking member |
| 244: | Extension/contraction portion | 245: | Ring portion |
| 247: | Protrusion | 250: | Intermediate part |
| 251: | Deformable portion | 260: | Skirt portion |
| 262: | Trench | 270: | Nozzle member |
| 271, 310: | Conduit | 272: | Nozzle body |
| 273: | Connection pipe | 274: | Fitting portion |
| 275: | Inflow hole | 276: | Extended portion |
| 280, 290: | Auxiliary check valve | 292: | Shaft portion |
| 294: | Lid | 300: | Discharge head |
| 320: | Outlet | 330: | Concave portion |
| 332: | Mounting groove | 350: | Stopper member |
| 360: | Cover | 362: | Hole |

What is claimed is:

1. A pumping member for a cosmetic container, which is made of a non-metallic elastic material and provided between a housing which is brought into close contact with an opened upper end of a container body and has a hole formed in a central portion of the housing to communicate with an interior of the container body configured to store contents of the cosmetic container and a discharge head configured to discharge the contents so as to transfer the contents, which is accommodated in an internal space of the pumping member, to the discharge head by a pumping operation implemented by being elastically compressed or expanded along an axial direction, the pumping member comprising:

a lower part coupled to the housing and connected to the hole of the housing; and an upper part in communication with the discharge head, wherein the upper part and the lower part are separated from each other and detachably coupled to each other.

2. The pumping member of claim 1, wherein the lower part includes:

a pressure portion having an internal space defined therein and configured to be compressed and elastically restored by an external force to vary a pressure of the internal space;

a flange mounted to an opening of the container body and formed to protrude outward from a lower outer circumferential surface of the pressure portion so as to be brought into close contact with a stepped portion of the housing;

a check valve formed integrally with a lower portion of the pressure portion and configured to selectively open or close the hole of the housing so as to allow the contents to flow from the container body into the pressure portion in one direction; and a groove portion formed to extend upward from an upper end of the pressure portion so as to be coupled to the upper part.

3. The pumping member of claim 2, wherein the upper part includes:

an insertion portion coupled to a nozzle member which connects the discharge head and the pumping member and in selective communication with an inner conduit of the nozzle member;

a blocking member whose inner diameter is increased inside the insertion portion in an elastic manner to form a passage through which the contents are discharged, and configured to be brought into close contact with the nozzle member to block between the pressure portion and the inner conduit of the nozzle member;

an extension/contraction portion formed in the insertion portion and configured to open or close between the blocking member and the nozzle member by extending or contracting the insertion portion in the elastic manner with a driving of the discharge head; and a ring portion formed at a lower end of the extension/contraction portion to be fitted into and coupled to the groove portion of the lower portion.

4. The pumping member of claim 1, wherein at least one intermediate part is stacked between the upper part and the lower part.

5. The pumping member of claim 4, wherein the at least one intermediate part has opened upper and lower ends and an internal space formed therein and is configured to connect the upper part and the lower part, wherein the ring portion, which is fitted into and coupled to the groove portion of the lower part, is formed on the lower end of the intermediate part, the groove portion into and to which the ring portion is fitted and coupled is formed in the upper end of the intermediate part, and a deformable portion, which is compressed and elastically restored by the external force to vary a pressure of the internal space, is formed between the ring portion and the groove portion.

6. A cosmetic container, comprising:

a container body in which contents are accommodated;

a pumping device coupled to an opened upper end of the container body and configured to discharge the contents accommodated in the container body by a pumping operation based on an elasticity of the pumping device;

a discharge head connected to the pumping device to apply a discharge pressure to the pumping device and having an outlet formed in one side to communicate with the pumping device and through which the contents are discharged, wherein the pumping device includes:

a housing which is brought into close contact with the opened upper end of the container body and has a hole formed in a central portion of the housing to communicate with an interior of the container body;

a pumping member provided inside the housing to be connected to the hole of the housing and having a content accommodation space defined therein, wherein the pumping member is elastically compressed or expanded along an axial direction to transfer the contents in one direction along the axial direction; and a nozzle member coupled to the pumping member and having an internal conduit formed therein to allow the contents to move, and configured to connect the pumping member and the outlet, compress the pumping member with an operation of the discharge head, and selectively open or close between the inner conduit and an internal space of the pumping member, and wherein the pumping member includes a lower part connected to the hole of the housing, and an upper part coupled to the nozzle member, and the upper part and the lower part are configured to be separated from each other and be detachably coupled to each other.

7. The cosmetic container of claim 6, wherein the lower part includes:

a pressure portion having an internal space defined therein and configured to be compressed and elastically restored by an external force to vary a pressure of the internal space;

a flange formed to protrude outward from a lower outer circumferential surface of the pressure portion so as to be brought into close contact with a stepped portion of the housing;

a check valve formed integrally with a lower portion of the pressure portion and configured to selectively open or close the hole of the housing so as to allow the contents to flow from the container body into the pressure portion in the one direction; and a groove portion formed to extend upward from an upper end of the pressure portion so as to be coupled to the upper part, and wherein the upper part includes:

an insertion portion coupled to the nozzle member and in selective communication with an inner conduit of the nozzle member;

a blocking member whose inner diameter is increased inside the insertion portion in an elastic manner to form a passage through which the contents are discharged, and configured to be brought into close contact with the nozzle member to block between the pressure portion and the inner conduit of the nozzle member;

an extension/contraction portion formed in the insertion portion and configured to open or close between the blocking member and the nozzle member by extending or contracting the insertion portion in the elastic manner with a driving of the discharge head; and a ring portion formed at a lower end of the extension/contraction portion to be fitted into and coupled to the groove portion of the lower portion.

8. The cosmetic container of claim 7, wherein the pumping member further includes at least one intermediate part stacked between the upper part and the lower part.

9. The cosmetic container of claim 7, wherein the nozzle member includes:

a nozzle body in which an inner conduit through which the contents are transferred is formed and which is fitted into and brought into close contact with an upper portion of the insertion portion of the pumping member;

a connection pipe extending in the axial direction on an upper end of the nozzle body, in which the inner conduit is formed and to which the discharge head is coupled;

a fitting portion formed on a lower end of the nozzle body to be inserted into the blocking member of the insertion portion;

an inflow hole formed in a lateral surface of the fitting portion to communicate interiors of the inner conduit and the insertion portion with each other; and an extended portion formed to protrude outward from an outer circumferential surface of the lower end of the fitting portion to be brought into close contact with an inner surface of the blocking member so as to block between the insertion portion and the extension/contraction portion.

10. The cosmetic container of claim 7, wherein the nozzle member is formed integrally with the discharge head.

11. The cosmetic container of claim 7, further comprising:

a skirt portion formed integrally with the lower outer circumferential surface of the pressure portion and having an outer diameter that becomes larger downward so that the skirt portion is brought into close contact with the inner surface of the cylinder chamber of the housing in an elastic manner; and at least one trench formed in the stepped portion of the housing to form a gap between the stepped portion and the flange at a portion in contact with the flange of the pumping member so that air allows to flow into the at least one trench through the gap.

12. The cosmetic container of claim 9, further comprising: an auxiliary check valve provided on the inner conduit to selectively block the inner conduit and configured to discharge the contents toward the discharge head in the one direction.

13. The cosmetic container of claim 10, further comprising:

a mounting groove formed to be depressed in a groove shape in the concave portion of the discharge head;

an auxiliary check valve provided in the mounting groove and configured to selectively block the internal conduit and discharge the contents toward the discharge head in the one direction; and a cover detachably provided in the mounting groove and having a hole formed in a surface of the cover to discharge the contents therethrough, and configured to cover and protect the auxiliary check valve.

* * * * *